United States Patent [19]

Morigaki et al.

[11] Patent Number: 4,735,893

[45] Date of Patent: Apr. 5, 1988

[54] SILVER HALIDE COLOR PHOTOGRAPHIC LIGHT-SENSITIVE MATERIAL

[75] Inventors: Masakazu Morigaki; Toshio Kawagishi; Kiyoshi Nakazyo; Nobuo Seto; Sadao Kamei, all of Kanagawa, Japan

[73] Assignee: Fuji Photo Film Co., Ltd., Kanagawa, Japan

[21] Appl. No.: 743,206

[22] Filed: Jun. 10, 1985

[30] Foreign Application Priority Data

Jun. 8, 1984 [JP] Japan ..... 59-118414

[51] Int. Cl.[4] ..... G03C 7/38

[52] U.S. Cl. ..... 430/551; 430/558

[58] Field of Search ..... 430/551, 558

[56] References Cited

U.S. PATENT DOCUMENTS

| | | | |
|---|---|---|---|
| 3,061,432 | 10/1962 | Menzel et al. | 430/558 |
| 3,573,050 | 3/1971 | Brannock et al. | 430/512 |
| 3,764,337 | 10/1973 | Arai et al. | 430/551 |
| 4,254,216 | 3/1981 | Uchida et al. | 430/551 |
| 4,360,589 | 11/1982 | Kojima et al. | 430/551 |
| 4,489,155 | 12/1984 | Sakanoue et al. | 430/558 |
| 4,500,630 | 2/1985 | Sato et al. | 430/558 |
| 4,540,654 | 9/1985 | Sato et al. | 430/558 |
| 4,562,146 | 12/1985 | Masuda et al. | 430/551 |
| 4,588,679 | 5/1986 | Furutachi | 430/551 |
| 4,623,617 | 11/1986 | Kaneko et al. | 430/558 |

FOREIGN PATENT DOCUMENTS

| | | |
|---|---|---|
| 0161577 | 4/1985 | European Pat. Off. . |
| 1810464 | 7/1969 | Fed. Rep. of Germany . |
| 2135788 | 9/1984 | United Kingdom . |

OTHER PUBLICATIONS

"Image Forming Process" Research Disclosure No. 245, 9/1984, pp. 442–454.

*Primary Examiner*—Richard L. Schilling

*Attorney, Agent, or Firm*—Sughrue, Mion, Zinn, Macpeak, and Seas

[57] ABSTRACT

A silver halide color photographic light-sensitive material containing a combination of a pyrazolo-azole magenta coupler and a specific dye image stabilizing agent is disclosed. The stabilizing agent is effective to improve fastness of a dye image formed by the coupler to light, heat and moisture.

21 Claims, No Drawings

SILVER HALIDE COLOR PHOTOGRAPHIC LIGHT-SENSITIVE MATERIAL

FIELD OF THE INVENTION

This invention relates to a silver halide color photographic light-sensitive material containing a combination of a pyrazolo-azole magenta coupler and a specific dye image stabilizing agent effective to improve light fastness of a dye image formed by the coupler.

BACKGROUND OF THE INVENTION

It is well known that, upon color development of a silver halide color photographic light-sensitive material, an oxidation product of an aromatic primary amine color developing agent reacts with a coupler to produce indophenol, indoaniline, indamine, azomethine, phenoxazine, phenazine or a like dye to thereby form a dye image.

Couplers which can be used for formation of magenta dyes images include 5-pyrazolone, cyanoacetophenone, indazolone, pyrazolobenzimidazole and pyrazolotriazole couplers.

Among them, magenta couplers that have hitherto been widely employed and undergone investigations are 5-pyrazolone couplers. It is known that dye images formed by 5-pyrazolone couplers have superior fastness to heat and light but contain a yellow component which shows unnecessary absorption at about 430 nm causing color turbidity.

In order to reduce the yellow component, there have conventionally been proposed coupler skeletons for formation of magenta dye images, such as a pyrazolobenzimidazole skeleton as described in British Pat. No. 1,047,612, an indazolone skeleton as described in U.S. Pat. No. 3,770,447 and a pyrazolotriazole as described in U.S. Pat. No. 3,725,067.

However, magenta couplers disclosed in these patents are still unsatisfactory for reasons that: they fail to provide satisfactory magenta dye images when dispersed in hydrophilic protective colloids, e.g., gelatin, and mixed with a silver halide emulsion; they have low solubility in high boiling organic solvents; they are difficult to synthesize; or they exhibit only relatively low coupling activity when processed with an ordinary developing solution.

The present inventors had previously developed pyrazolo-azole magenta couplers including imidazo[1,2-b]pyrazoles pyrazolo[1,5-b][1,2,4]triazoles, pyrazolo[1,5-d]tetrazoles, pyrazolo[1,5-d]benzimidazoles, and pyrazolopyrazoles which are free from the above described disadvantages.

It was noted, however, that azomethine dyes formed by these pyrazolo-azole magenta couplers show relatively low fastness to light, heat or moisture, and also conventionally employed general dye image stabilizing agents, such as alkyl-substituted hydroquinones, cannot sufficiently prevent discoloration of these dye images.

SUMMARY OF THE INVENTION

An object of this invention is to provide a silver halide color photographic light-sensitive material containing a pyrazolo-azole coupler represented by the formula (I) hereinafter described, which can provide a magenta dye image having improved fastness to light, heat or moisture.

It has now been found that the above described object can be accomplished by incorporating a compound represented by the formula (II) hereinafter described in a silver halide color photographic light-sensitive material containing the pyrazolo-azole coupler of the formula (I).

DETAILED DESCRIPTION OF THE INVENTION

The pyrazolo-azole coupler which can be used in the present invention is represented by the formula (I):

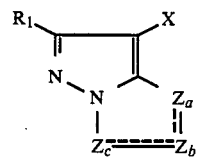

(I)

wherein $R_1$ represents a hydrogen atom or an organic substituent; X represents a hydrogen atom or a group releasable upon a coupling reaction with an oxidation product of an aromatic primary amine developing agent; $Z_a$, $Z_b$ and $Z_c$ each represents a methine group, a substituted methine group, =N— or —NH—, with the proviso that the case wherein $Z_a$ and $Z_b$ are nitrogen atoms and $Z_c$ is a methine group or a substituted methine group is excluded; the dotted line represents a single bond or a double bond and one of $Z_a$-$Z_b$ bond and $Z_b$-$Z_c$ bond is a double bond and the other is a single bond; when $Z_b$-$Z_c$ is a carbon-carbon double bond, $Z_b$-$Z_c$ may be a part of a condensed aromatic ring; when $R_1$ or X is a divalent group, the compound of the general formula (I) may form a di- or polymer; and when $Z_a$, $Z_b$ or $Z_c$ is a substituted methine group, the compound of the general formula (I) may form a di- or polymer.

The organic substituent represented by $R_1$ may contain an oxygen atom, a nitrogen atom or a sulfur atom.

The term "di- or polymer" as used in the definition for the above described formula (I) means a compound containing at least two partial structures represented by the formula (I) in its molecule, and includes a bis compound and a polymer coupler. The term "polymer coupler" as herein used include a homopolymer solely comprising a monomer having a moiety represented by the formula (I), and preferably having a vinyl group (the monomer having a vinyl group will hereinafter be referred to as a vinyl monomer), and a copolymer comprising said monomer and a non-color-forming ethylenically unsaturated monomer incapable of coupling with an oxidation product of an aromatic primary amine developing agent.

The compounds represented by the formula (I) are couplers having a 5-membered ring-5-membered ring condensed nitrogen-containing heterocyclic ring. Their color forming nuclei show aromaticity isoelectronic to naphthalene and have chemical structures inclusively called azapentalene. The preferred compounds among the couplers of the formula (I) are 1H-imidazo[1,2-b]pyrazoles, 1H-pyrazolo[1,5-b]pyrazoles, 1H-pyrazolo[1,5-b][1,2,4]triazoles, 1H-pyrazolo[1,5-d]tetrazoles and 1H-pyrazolo[1,5-a]benzimidazoles represented by the formulae (I-1), (I-2), (I-3), (I-4) and (I-5), respectively. Of these, the compounds of the formulae (I–1), and (I–3) are particularly preferred.

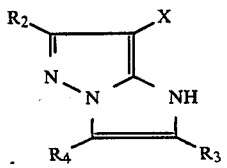
(I-1)

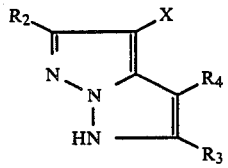
(I-2)

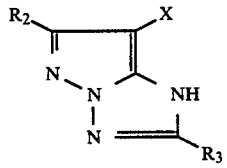
(I-3)

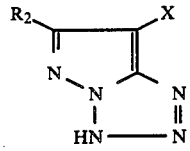
(I-4)

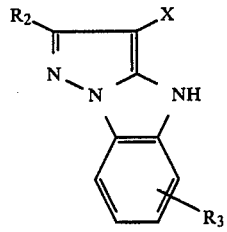
(I-5)

wherein $R_2$, $R_3$ and $R_4$ each represents a hydrogen atom, a halogen atom, an alkyl group, an aryl group, a heterocyclic group, a cyano group, an alkoxy group, an aryloxy group, a heterocyclic oxy group, an acyloxy group, a carbamoyloxy group, a silyloxy group, a sulfonyloxy group, an acylamino group, an anilino group, a ureido group, an imido group, a sulfamoylamino group, a carbamoylamino group, an alkylthio group, an arylthio group, a heterocyclic thio group, an alkoxycarbonylamino group, an aryloxycarbonylamino group, a sulfonamido group, a carbamoyl group, an acyl group, a sulfamoyl group, a sulfonyl group, a sulfinyl group, an alkoxycarbonyl group or an aryloxycarbonyl group; X represents a hydrogen atom, a halogen atom, a carboxyl group or a group which is bonded to the coupling carbon atom via an oxygen, nitrogen or sulfur atom and capable of releasing upon coupling; when $R_2$, $R_3$, $R_4$ or X is a divalent group, the compound represented by the formula (I-1), (I-2), (I-3), (I-4) or (I-5) forms a di- or polymer; and when the formula (I-1), (I-2), (I-3), (I-4) or (I-5) constitutes a partial structure of a vinyl monomer, $R_2$, $R_3$ or $R_4$ represents a mere bond or a linking group, via which said partial structure of the formula (I-1), (I-2), (I-3), (I-4) or (I-5) and the vinyl group are bonded together.

More specifically, $R_2$, $R_3$ and $R_4$ each represents a hydrogen atom, a halogen atom (e.g., a chlorine atom, a bromine atom, etc.), an alkyl group (e.g., a methyl group, a propyl group, a t-butyl group, a trifluoromethyl group, a tridecyl group, a 3-(2,4-di-t-amylphenoxy)propyl group, a 2-dodecyloxyethyl group, a 3-phenoxypropyl group, a 2-hexylsulfonylethyl group, a cyclopentyl group, a benzyl group, etc.), an aryl group (e.g., a phenyl group, a 4-t-butylphenyl group, a 2,4-di-t-amylphenyl group, a 4-tetradecaneamidophenyl group, etc.), a heterocyclic group (e.g., a 2-furyl group, a 2-thienyl group, a 2-pyrimidinyl group, a 2-benzothiazolyl group, etc.), a cyano group, an alkoxy group (e.g., a methoxy group, an ethoxy group, a 2-methoxyethoxy group, a 2-dodecyloxyethoxy group, a 2-methanesulfonylethoxy group, etc.), an aryloxy group (e.g., a phenoxy group, a 2-methylphenoxy group, a 4-t-butylphenoxy group, etc.), a heterocyclic oxy group (e.g., a 2-benzimidazolyloxy group, etc.), an acyloxy group (e.g., an acetoxy group, a hexadecanoyloxy group, etc.), a carbamoyloxy group (e.g., an N-phenylcarbamoyloxy group, an N-ethylcarbamoyloxy group, etc.), a silyloxy group (e.g., a trimethysilyloxy group, etc.), a sulfonyloxy group (e.g., a dodecylsulfonyloxy group, etc.), an acylamino group (e.g., an acetamido group, a benzamido group, a tetradecaneamido group, an α-(2,4-di-t-amylphenoxy)-butyramido group, a γ-(3-t-butyl-4-hydroxyphenoxy)-butyramido group, an α-[4-(4-hydroxyphenylsulfonyl)-phenoxy]decaneamido group, etc.), an anilino group (e.g., a phenylamino group, a 2-chloroanilino group, a 2-chloro-5-tetradecaneamidoanilino group, a 2-chloro-5-dodecyloxycarbonylanilino group, an N-acetylanilino group, a 2-chloro-5-[α-(3-t-butyl-4-hydroxyphenoxy)-dodecaneamino]anilino group, etc.), a ureido group (e.g., a phenylureido group, a methylureido group, an N,N-dibutylureido group, etc.), an imido group (e.g., an N-succinimido group, a 3-benzylhydantoinyl group, a 4-(2-ethylhexanoylamino)phthalimido group, etc.), a sulfamoylamino group (e.g., an N,N-dipropylsulfamoylamino group, an N-methyl-N-decylsulfamoylamino group, etc.), a carbamoylamino group (e.g., an N,N-diethylcarbamoylamino group, etc.), an alkylthio group (e.g., a methylthio group, an octylthio group, a tetradecylthio group, a 2-phenoxyethylthio group, a 3-phenoxypropylthio group, a 3-(4-t-butylphenoxy)propylthio group, etc.), an arylthio group (e.g., a phenylthio group, a 2-butoxy-5-t-octylphenylthio group, a 3-pentadecylphenylthio group, a 2-carboxyphenylthio group, a 4-tetradecaneamidophenylthio group, etc.), a heterocyclic thio group (e.g., a 2-benzothiazolylthio group, etc.), an alkoxycarbonylamino group (e.g., a methoxycarbonylamino group, a tetradecyloxycarbonylamino group, etc.), an aryloxycarbonylamino group (e.g., a phenoxycarbonylamino group, a 2,4-di-t-butylphenoxycarbonylamino group, etc.), a sulfonamido group (e.g., a methanesulfonamido group, a hexadecanesulfonamido group, a benzenesulfonamido group, a p-toluenesulfonamido group, an octadecanesulfonamido group, a 2-methyloxy-5-t-butylbenzenesulfonamido group, etc.), a carbamoyl group (e.g., an N-ethylcarbamoyl group, an N,N-dibutylcarbamoyl group, an N-(2-dodecyloxyethyl)carbamoyl group, an N-methyl-N-dodecylcarbamoyl group, an N-[3-(2,4-di-t-amylphenoxy)propyl]carbamoyl group, etc.), an acyl group (e.g., an acetyl group, a (2,4-di-t-amylphenoxy)acetyl group, a benzoyl group, etc.), a sulfamoyl group (e.g., an N-ethylsulfamoyl group, an N,N-dipropylsulfamoyl group, an N-(2-dodecyloxyethyl)sulfamoyl group, an N-ethyl-N-dodecylsulfamoyl group, an N,N-diethylsulfamoyl group, etc.), a sulfonyl group (e.g., a methanesulfonyl group, an octanesulfonyl group, a benzenesulfonyl group, a toluenesulfonyl group, etc.), a sulfinyl group (e.g., an octanesulfinyl group, a dodecylsulfinyl group, a phenylsulfinyl group, etc.), an alkoxycarbonyl group (e.g., a methoxycarbonyl group, a butyloxycarbonyl group, a dodecyloxycarbonyl group, an octadecyloxycarbonyl group, etc.), or an aryloxycarbonyl group (e.g., a phenyloxycarbonyl group, a 3-pentadecyloxycarbonyl group, etc.). X represents a hydrogen atom, a halogen atom (e.g., a chlorine atom, a bromine atom, an iodine atom, etc.), a carboxyl group, a group bonded via an oxygen atom (e.g., an acetoxy group, a propanoyloxy group, a benzoyloxy group, a 2,4-dichlorobenzoyloxy group, an ethoxyoxazoyloxy group, a pyruvinyloxy group, a cinnamoyloxy group, a phenoxy group, a 4-cyanophenoxy group, a 4-methanesulfonamidophenoxy group, a 4-methanesulfonylphenoxy group, an α-naphthoxy group, a 3-pentadecylphenoxy group, a benzyloxycarbonyloxy group, an ethoxy group, a 2-cyanoethoxy group, a benzyloxy group, a 2-phenethyloxy group, a 2-phenoxyethoxy group, a 5-phenyltetrazolyloxy group, a 2-benzothiazolyloxy group, etc.), a group bonded via a nitrogen atom (e.g., a benzenesulfonamido group, an N-ethyltoluenesulfonamido group, a heptafluorobutaneamido group, a 2,3,4,5,6-pentafluorobenzamido group, an octanesulfonamido group, a p-cyanophenylureido group, an N,N-diethylsulfamoylamino group, a 1-piperidyl group, a 5,5-dimethyl-2,4-dioxo-3-oxazolidinyl group, a 1-benzylethoxy-3-hydantoinyl group, a 2N-1,1-dioxo-3(2H)-oxo-1,2-benzisothiazolyl group, a 2-oxo-1,2-dihydro-1-pyridinyl group, an imidazolyl group, a pyrazolyl group, a 3,5-diethyl-1,2,4-triazol-1-yl group, a 5- or 6-bromobenzotriazol-1-yl group, a 5-methyl-1,2,3,4-triazol-1-yl group, a benzimidazolyl group, a 3-benzyl-1-hydantoinyl group, a 1-benzyl-5-hexadecyloxy-3-hydantoinyl group, a 5-methyl-1-tetrazolyl group, a 4-methoxyphenylazo group, a 4-pivaloylaminophenylazo group, a 2-hydroxy-4-propanoylphenylazo group, etc.), or a group bonded via a sulfur atom (e.g., a phenylthio group, a 2-carboxyphenylthio group, a 2-methoxy-5-t-octylphenylthio group, a 4-methanesulfonylphenylthio group, a 4-octanesulfonamidophenylthio group, a 2-butoxyphenylthio group, a 2-(2-hexanesulfonylethyl)-5-t-octylphenylthio group, a benzylthio group, a 2-cyanoethylthio group, a 1-ethoxycarbonyltridecylthio group, a 5-phenyl-2,3,4,5-tetrazolylthio group, a 2-benzothiazolylthio group, a 2-dodecylthio-5-thiophenylthio group, a 2-phenyl-3-dodecyl-1,2,4-triazolyl-5-thio group, etc.).

In the cases when $R_2$, $R_3$, $R_4$ or X is a divalent group to form a bis compound or a polymer, such a divalent group includes a substituted or unsubstituted alkylene group (e.g., a methylene group, an ethylene group, a 1,10-decylene group, a group of $—CH_2CH_2—O—CH_2CH_2—$, etc.), a substituted or unsubstituted phenylene group (e.g., a 1,4-phenylene group, a 1,3-phenylene group,

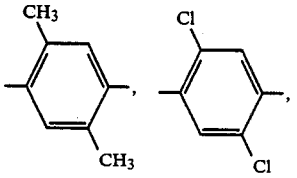

etc.) and a group of $—NHCO—R_5—CONH—$, wherein $R_5$ represents a substituted or unsubstituted alkylene group or a substituted or unsubstituted phenylene group.

In the cases when $R_2$, $R_3$ or $R_4$ is a mere bond or a linking group to form a vinyl monomer, such a linking group includes a substituted or unsubstituted alkylene group (e.g., a methylene group, an ethylene group, a 1,10-decylene group, $—CH_2CH_2OCH_2CH_2—$, etc.), a substituted or unsubstituted phenylene group (e.g., a 1,4-phenylene group, a 1,3-phenylene group,

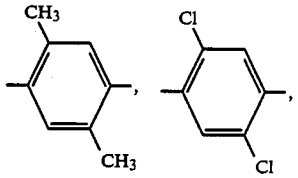

etc.), —NHCO—, —CONH—, —O—, —OCO—, an aralkylene group (e.g.,

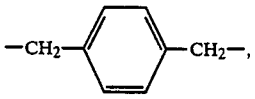

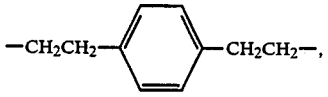

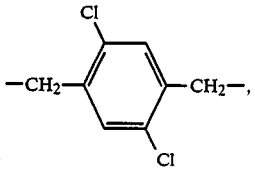

etc.) and combinations thereof.

The vinyl group as shown in the aforesaid formulae (I-1) to (I-5) may be substituted. Preferred substituents for the vinyl group include a hydrogen atom, a chlorine atom or a lower alkyl group having from 1 to 4 carbon atoms.

The non-color-forming ethylenically unsaturated monomer incapable of coupling with an oxidation product of an aromatic primary amine developing agent includes acrylic acids, such as acrylic acid, α-chloroacrylic acid and an α-alacrylic acid (e.g., methacrylic acid), esters or amides of these acrylic acids (e.g., acrylamide, n-butylacrylamide, t-butylacrylamide, diacetoneacrylamide, methacrylamide, methyl acrylate, ethyl acrylate, n-propyl acrylate, n-butyl acrylate, t-butyl acrylate, isobutyl acrylate, 2-ethylhexyl acrylate, n-octyl acrylate, lauryl acrylate, methyl methacrylate, ethyl methacrylate, n-butyl methacrylate, β-hydroxy methacrylate, etc.), methylenebisacrylamide, vinyl esters (e.g., vinyl acetate, vinyl propionate, vinyl laurate, etc.), acrylonitrile, methacrylonitrile, aromatic vinyl compounds (e.g., styrene and its derivatives, vinyltoluene, divinylbenzene, vinylacetophenone, sulfostyrene, etc.), itaconic acid, citraconic acid, crotonic acid, vinylidene chloride, vinyl alkyl ethers (e.g., vinylethyl ether, etc.), maleic acid, maleic anhydride, maleic esters, N-vinyl-2-pyrrolidone, N-vinylpyridine, 2-, 3- or 4-vinylpyridine, and the like. These monomers can be used alone or in combinations of two or more thereof.

Specific examples of the couplers represented by the formulae (I-1) through (I-5) and processes for synthesizing them are described in the following literatures.

The compounds of the formula (I-1) are described in U.S. Pat. No. 4,500,630, etc.; the compounds of the formula (I-2), in Japanese Patent Application (OPI) No. 43659/85 (the term "OPI" as used herein refers to a "published unexamined Japanese patent application"), etc.; the compounds of the formula (I-3), in European Patent Application No. EP-119860A; the compounds of the formula (I-4), in Japanese Patent Application (OPI) No. 33552/85; and the compounds of the formula (I-5), in U.S. Pat. No. 3,061,432, etc.; respectively.

In addition, highly color forming ballast groups disclosed, e.g., in Japanese Patent Application (OPI) No. 42045/83, European Patent Application No. EP-126433A, U.S. Pat. Nos. 4,513,082 and 4,503,141 and Japanese Patent Application (OPI) No. 177556/84, etc., can be applied to any of the compounds of the formulae (I-1) through (I-5).

Specific examples of the pyrazolo-azole couplers which can be used in the present invention are shown below only for illustrative purpose but not for limitation:

(M-1)

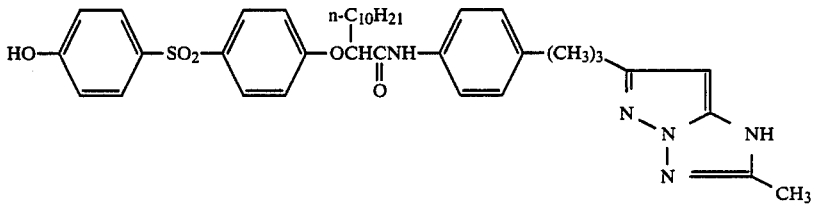

(M-2)

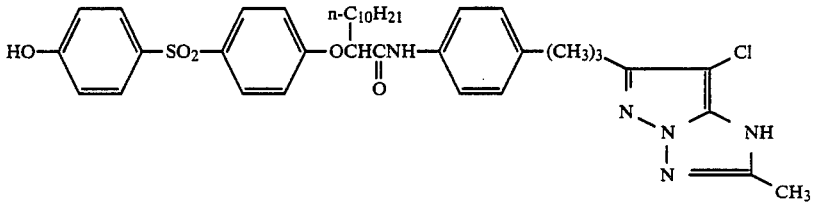

(M-3)

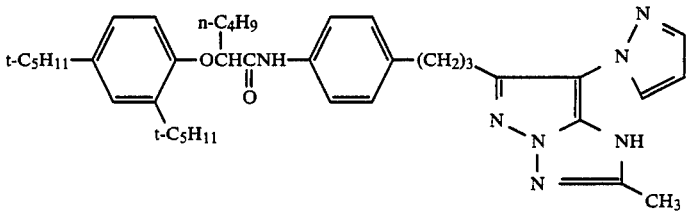

(M-4)

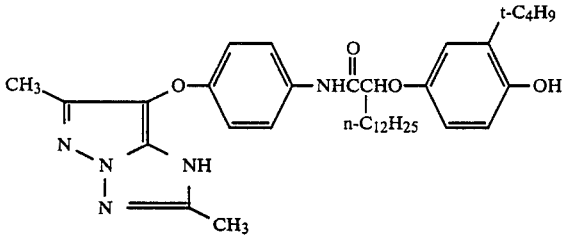

(M-5)

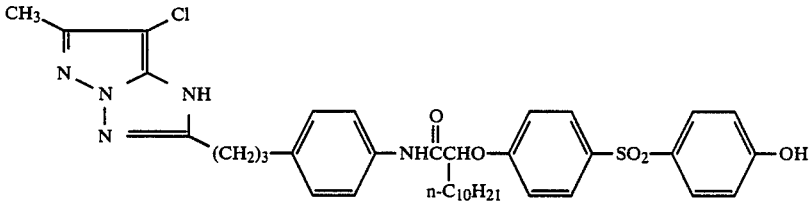

(M-6)

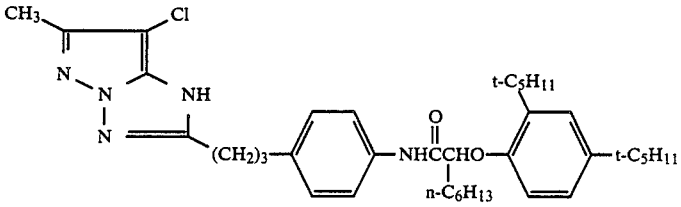

-continued
(M-7)
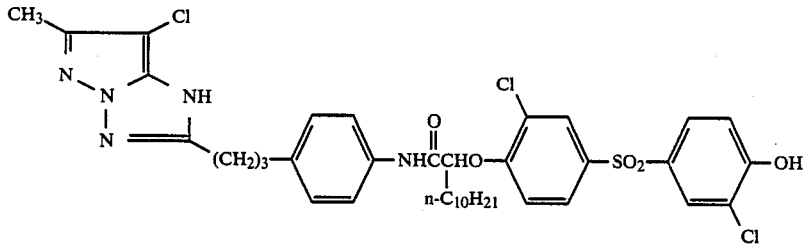
(M-8)
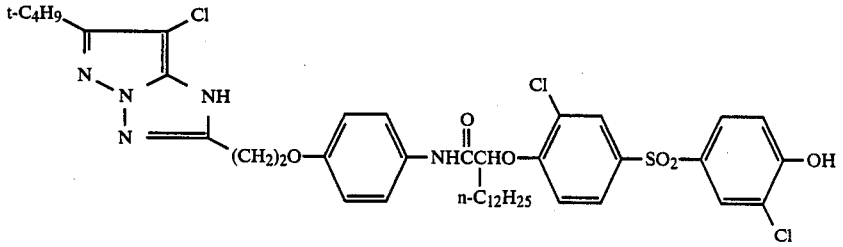
(M-9)
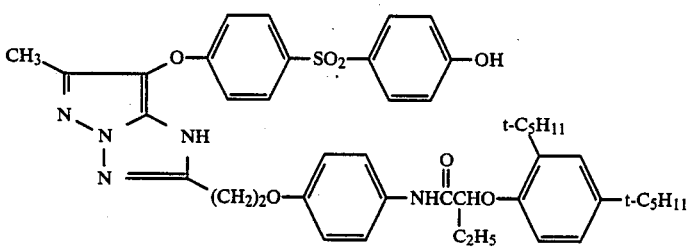
(M-10)
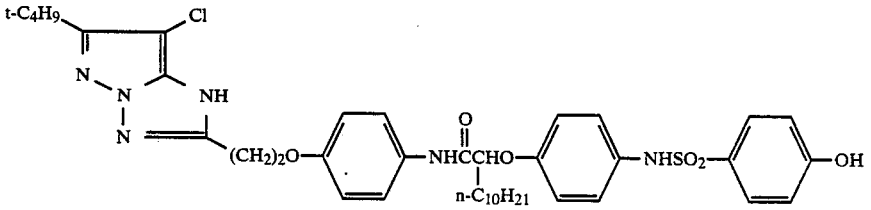
(M-11)
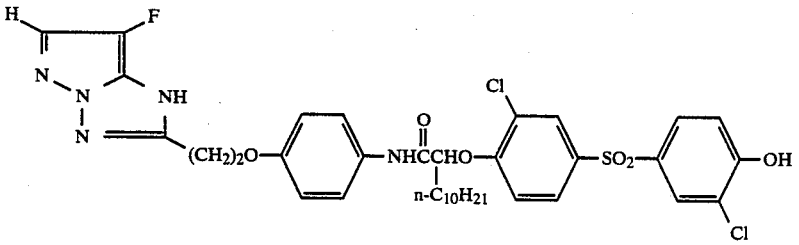
(M-12)
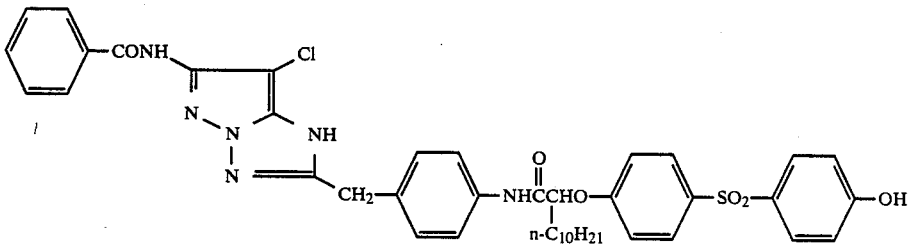

-continued
(M-13)
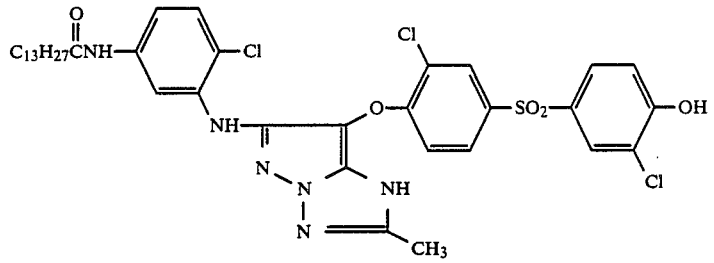
(M-14)
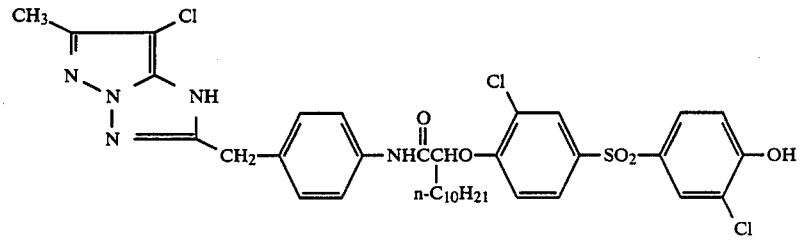
(M-15)
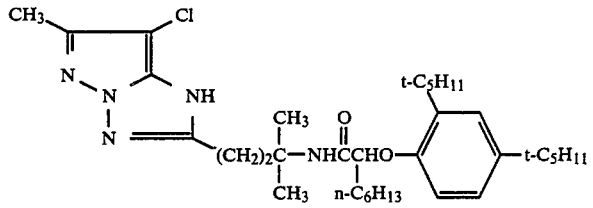
(M-16)
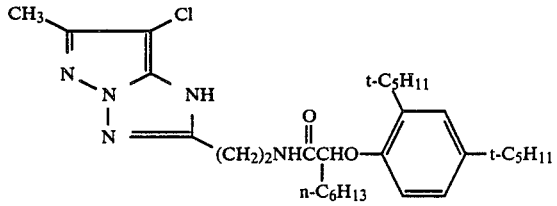
(M-17)
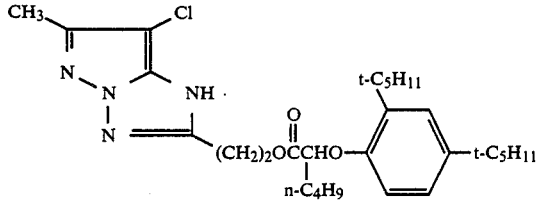
(M-18)
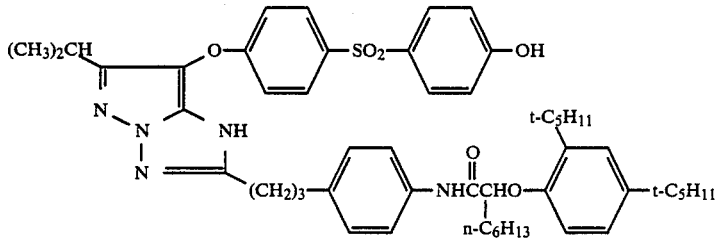
(M-19)
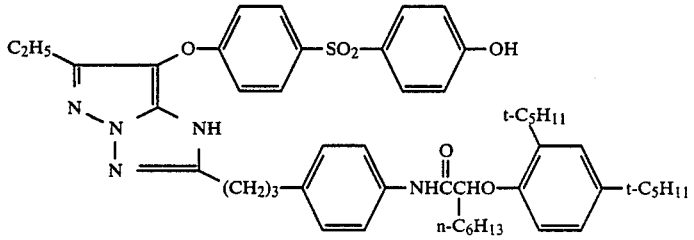

-continued
(M-20)
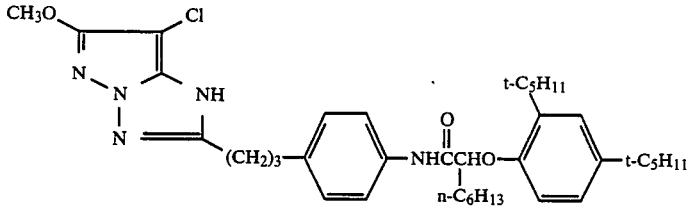
(M-21)
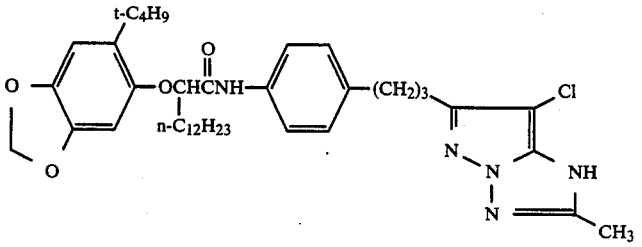
(M-22)
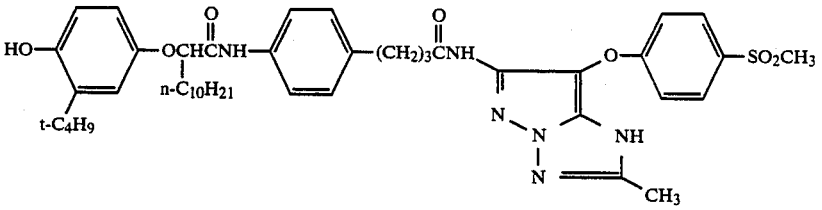
(M-23)
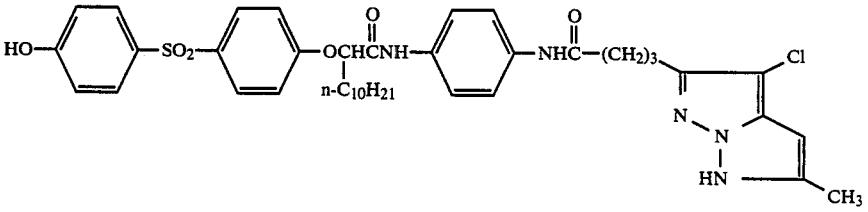
(M-24)
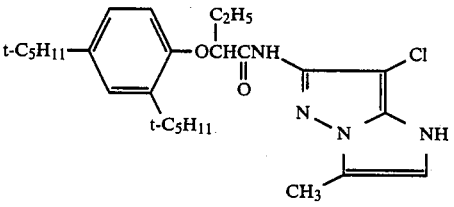
(M-25)
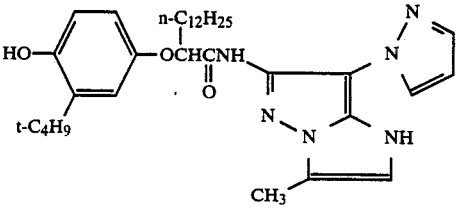
(M-26)
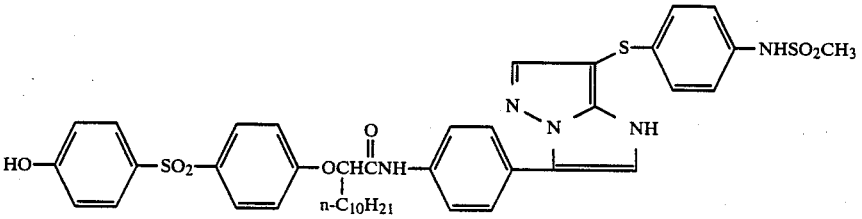

-continued
(M-27)
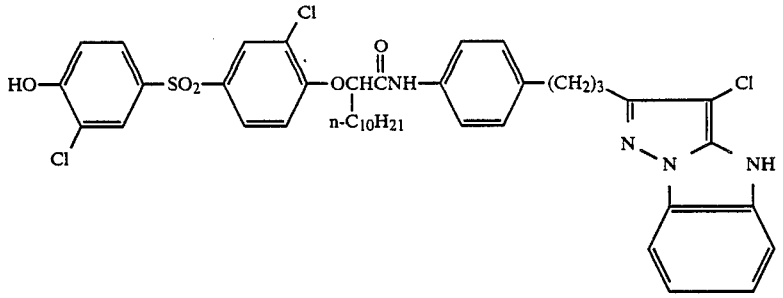
(M-28)
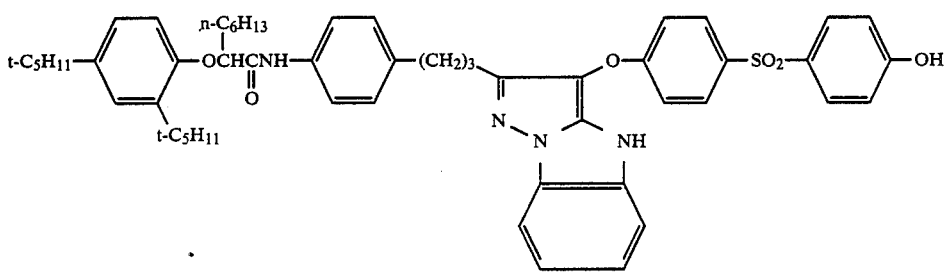
(M-29)
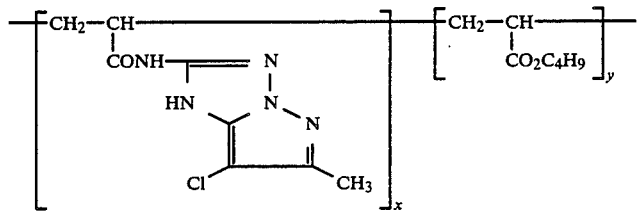
x:y = 50:50 (weight ratio)
(M-30)
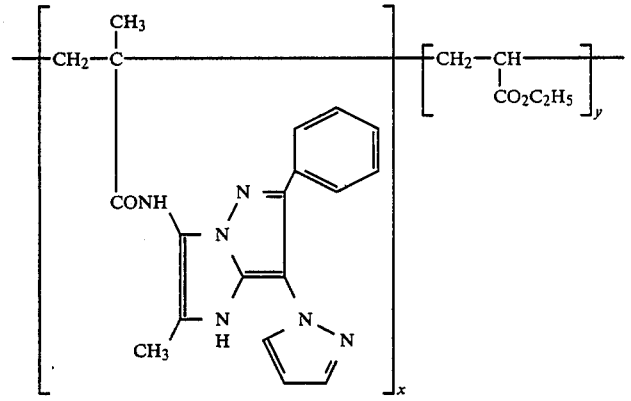
x:y = 55:45 (weight ratio)
(M-31)
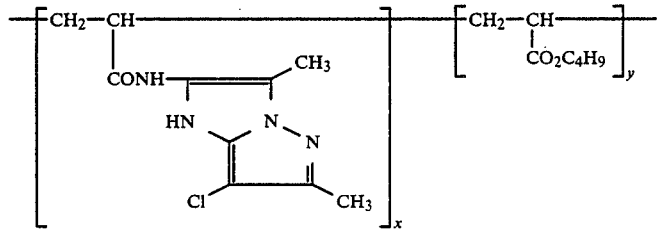
x:y = 50:50 (weight ratio)

-continued (M-32)

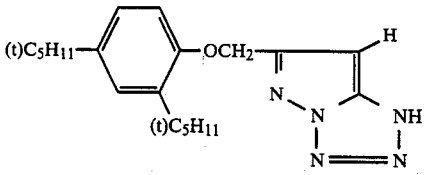

The couplers according to the present invention are usually used in an amount of from $2\times10^{-3}$ to $5\times10^{-1}$ mol, and preferably from $1\times10^{-2}$ to $5\times10^{-1}$ mol, per mol of silver.

Dye image stabilizing agents which can be used in combination with the magenta couplers of the formula (I) in accordance with the present invention are represented by the formula (II):

(II)

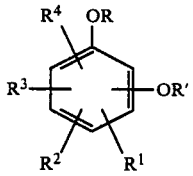

wherein R and R', which may be the same or different, each represents an alkyl group; $R^1$, $R^2$, $R^3$ and $R^4$, which may be the same or different, each represents a hydrogen atom, an alkyl group, an aryl group, an alkoxy group, an alkylthio group, an acylamino group, a hydroxyl group or a halogen atom; at least one of OR and OR' may be taken together with any of $R^1$, $R^2$, $R^3$ and $R^4$ that is in an ortho-position to OR or OR' to form a 5- or 6-membered ring; and at least one of pairs of $R^1$, $R^2$, $R^3$ and $R^4$, each pair being in an ortho-position to each other, may be taken together to form a 5- or 6-membered ring.

More specifically, R and R' each represents a straight or branched chain or cyclic alkyl group having from 1 to 20 carbon atoms, such as a methyl group, an ethyl group, a propyl group, an n-butyl group, an isobutyl group, an n-octyl group, an n-dodecyl group, an n-hexadecyl group, a cyclohexyl group, etc. R and R' may be the same or different. $R^1$, $R^2$, $R^3$ and $R^4$, which may be the same or different, each represents a hydrogen atom, a straight or branched chain or cyclic alkyl group having from 1 to 20 carbon atoms (e.g., a methyl group, an ethyl group, a t-butyl group, a t-hexyl group, a t-octyl group, a sec-dodecyl group, an n-hexadecyl group, a cyclohexyl group, etc.), an aryl group having from 6 to 20 carbon atoms (e.g., a phenyl group, a naphthyl group, etc.), an alkoxy group having from 1 to 20 carbon atoms (e.g., a methoxy group, an ethoxy group, an n-butoxy group, an isobutoxy group, an n-octyloxy group, an n-hexadecyloxy group, etc.), an alkylthio group having from 1 to 20 carbon atoms (e.g., a methylthio group, an n-butylthio group, an n-octylthio group, etc.), an acylamino group having from 1 to 20 carbon atoms (e.g., an acetylamino group, a propionylamino group, etc.), a hydroxyl group or a halogen atom (e.g., a chlorine atom, a bromine atom, etc.). The 5- or 6-membered ring formed by OR or OR' and one of $R^1$ to $R^4$ being an an ortho-position includes a chroman ring, a spirochroman ring, a coumarin ring, etc. The 5- or 6-membered ring formed by any two of $R^1$ to $R^4$ being in an ortho-position to each other includes an aliphatic ring, a heterocyclic ring, an aromatic ring, a spiro ring, etc. Of the above enumerated groups for R, R', $R^1$, $R^2$, $R^3$ and $R^4$, those groups containing an alkyl or aryl moiety may be substituted at the alkyl or aryl moiety. Examples of preferred substituents are an alkyl group, an aryl group, an alkoxy group, an aryloxy group, an alkylthio group, an arylthio group, an acyl group, an acylamino group, a hydroxyl group, a halogen atom, a cyano group, an alkoxycarbonyl group, a carbamoyl group, a sulfamoyl group, an acyloxy group, a nitro group, and the like.

The preferred compounds among the compounds represented by the formula (II) are those in which OR' is in an ortho-position or para-position to OR. The more preferred are the compounds represented by the formulae (II-1) through (II-5).

(II-1)

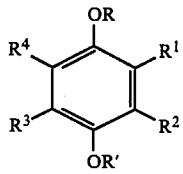

(II-2)

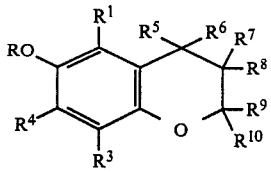

(II-3)

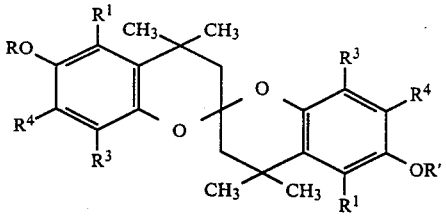

(II-4)

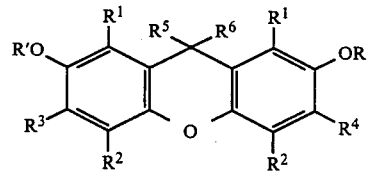

(II-5)

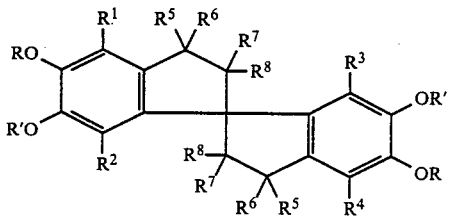

wherein R, R', $R^2$, $R^3$ and $R^4$ are as defined above; $R^5$, $R^6$, $R^7$, $R^8$, $R^9$ and $R^{10}$, which may be the same or different, each represents a hydrogen atom, an alkyl group, an aryl group, an alkoxy group, a heterocyclic group, an alkylamino group or an alkoxycarbonyl group.

More specifically, $R^5$, $R^6$, $R^7$, $R^8$, $R^9$ and $R^{10}$ each represents a hydrogen atom, a straight or branched chain or cyclic alkyl group having from 1 to 20 carbon atoms (e.g., a methyl group, an ethyl group, an n-butyl group, an n-octyl group, a cyclohexyl group, etc.), an aryl group having from 6 to 20 carbon atoms (e.g., a phenyl group, a naphthyl group, etc.), an alkoxy group having from 1 to 20 carbon atoms (e.g., a methoxy group, an n-butoxy group, an n-octyloxy group, etc.), a heterocyclic group (e.g., a morpholinyl group, etc.), an alkylamino group having from 1 to 20 carbon atoms (e.g., a diethylamino group, a dibutylamino group, an n-octylamino group, etc.) or an alkoxycarbonyl group having from 1 to 20 carbon atoms (e.g., an ethoxycarbonyl group, an n-hexyloxycarbonyl group, etc.).

Among the compounds represented by the formulae (II-1) through (II-5), the compound represented by the formula (II-5) can provide superior effect as compared with the other compounds.

In carrying out the present invention, these dye image stabilizing agents can be used alone or in combinations of two or more thereof, or in combination with other conventional discoloration inhibitors.

The conventional discoloration inhibitors include hydroquinones, phenols, chromanols, coumarans, hindered amines, complex compounds, and the like. Specific examples of these discoloration inhibitors are given, e.g., in Japanese Patent Application (OPI) Nos. 83162/84, 24141/83 and 152225/77, U.S. Pat. Nos. 3,698,909 and 4,268,593 and British Pat. Nos. 2,069,162 (A) and 2,027,731, etc.

Specific examples of the compounds represented by the formula (II) are shown below only for illustrative purpose but not for limitation.

A-1

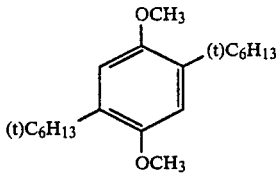

A-2

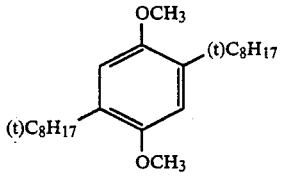

A-3

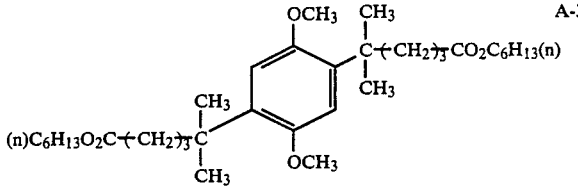

A-4

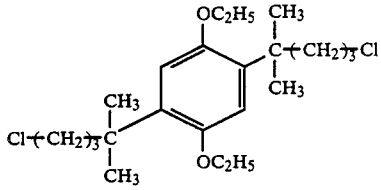

A-5

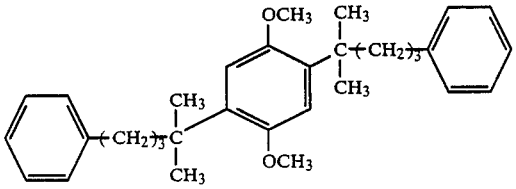

A-6

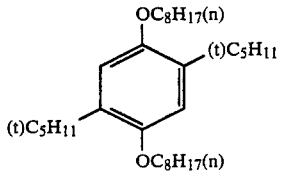

A-7

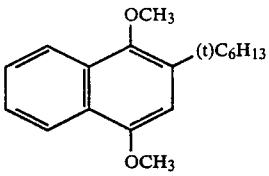

A-8

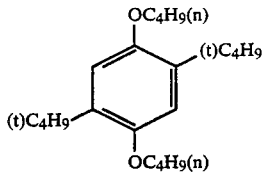

A-9

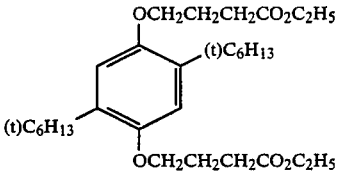

A-10

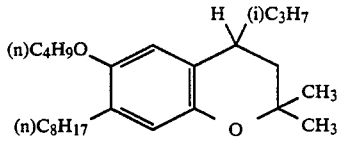

A-11

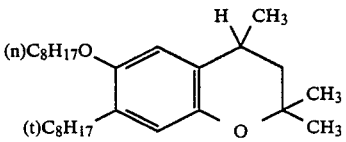

A-12

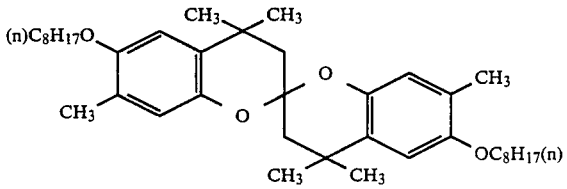

-continued
A-13
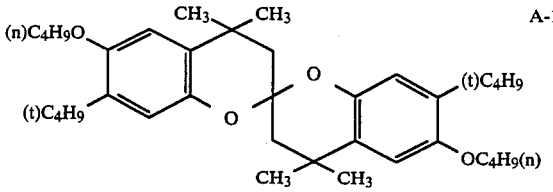
A-14
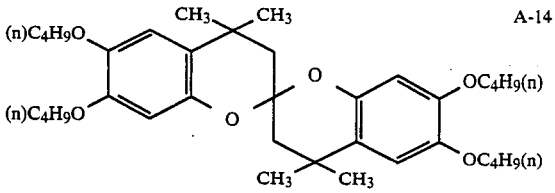
A-15
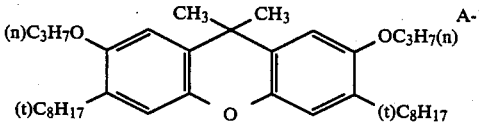
A-16
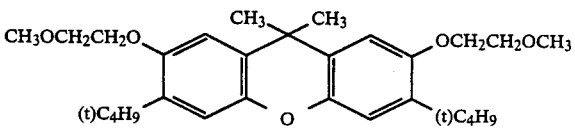
A-17
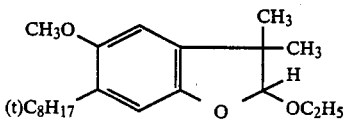
A-18
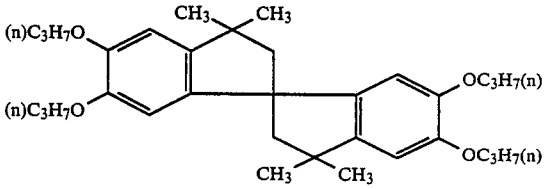
A-19
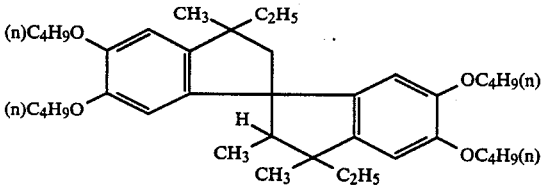
A-20
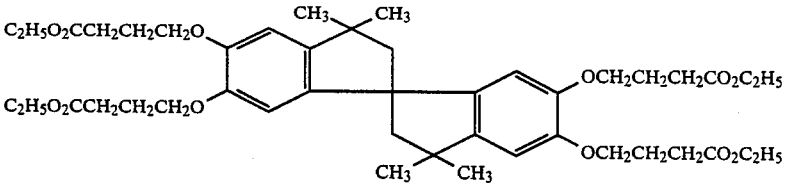
A-21
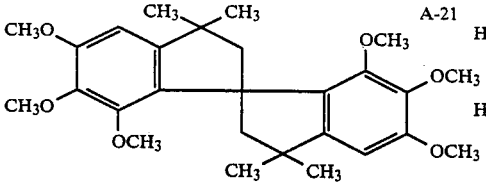
A-22
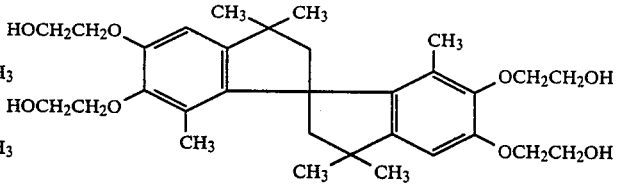
A-23
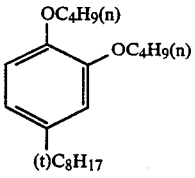
A-24
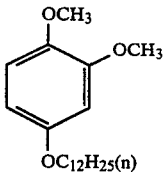
A-25
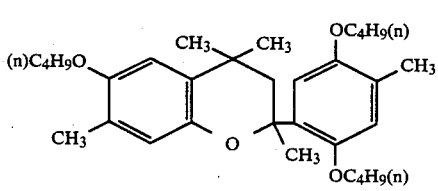
A-26
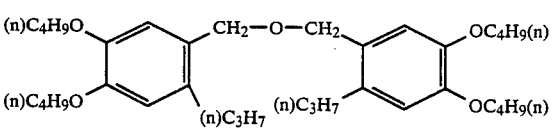

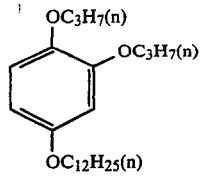

-continued

A-27

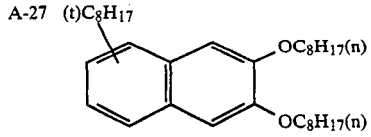

A-28

The compounds of the formula (II) according to the present invention can easily be synthesized by the processes described in U.S. Pat. Nos. 4,360,589 and 4,273,864, Japanese Patent Application (OPI) Nos. 50244/80, 20327/78, 77526/78 and 10539/84 and Japanese Patent Publication No. 37856/82, etc., or processes analogous thereto.

The amount of the compound (II) to be used varies depending on the kind of couplers used in combination, but suitably ranges from 0.5 to 200% by weight, and more preferably from 2 to 150% by weight, based on the coupler. In other words, the amount of the compound (II) used suitably ranges from 2 to 300 mol%, and more preferably from 10 to 150 mol%, based on the coupler. An amount less than 0.5% by weight produces only a little effect of discoloration inhibition being insufficient for practical use. On the other hand, too large an amount results in hinderance of development progress, possibly causing reduction of color density.

In order to meet characteristic requirements for light-sensitive materials, two or more different kinds of the compounds of the formula (II) can be incorporated in one layer, or the same compound may be incorporated in two or more layers.

The coupler of the formula (I) and the compound of the formula (II) are preferably incorporated in a silver halide emulsion layer.

Incorporation of couplers or the compounds of the formula (II) into a silver halide emulsion layer can be effected by known processes, e.g., the process as described in U.S. Pat. No. 2,322,027.

For example, the compound is dissolved in a high boiling organic solvent, such as an alkyl phthalate (e.g., dibutyl phthalate, dioctyl phthalate, etc.), a phosphoric ester (e.g., diphenyl phosphate, triphenyl phosphate, tricresyl phosphate, dioctylbutyl phosphate, etc.), a citric ester (e.g., tributyl acetylcitrate, etc.), a benzoic ester (e.g., octyl benzoate, etc.), an alkylamide (e.g., diethyllaurylamide, etc.), a fatty acid amide (e.g., dibutoxyethyl succinate, diethyl azelate, etc.), a trimesic ester (e.g., tributyl trimesate, etc.), and the like, or a low boiling organic solvent having a boiling point of from about 30° to 150° C., such as lower alkyl acetates (e.g., ethyl acetate, butyl acetate, etc.), ethyl propionate, sec-butyl alcohol, methyl isobutyl ketone, β-ethoxyethyl acetate, methyl cellosolve acetate, and the like, or a mixture of the high boiling organic solvent and the low boiling organic solvent. The resulting solution is then dispersed in a hydrophilic colloid.

A dispersion method using polymers, as disclosed in Japanese Patent Publication No. 39853/76 and Japanese Patent Application (OPI) No. 59943/76 may also be employed.

When the coupler contains an acid group, such as a carboxyl group and a sulfo group, it is incorporated in a hydrophilic colloid in the form of an alkaline aqueous solution.

Photographic color couplers to be used are advantageously selected so as to provide middle scale images. It is preferable that cyan dyes obtained from cyan couplers show their absorption maxima at about 600 to 720 nm; magenta dyes obtained from magenta couplers show their absorption maxima at about 500 to 580 nm; and yellow dyes formed by yellow couplers show their absorption maxima at about 400 to 480 nm.

In the present invention, conventional color forming couplers, i.e., compounds capable of forming colors by oxidative coupling with aromatic primary amine developers (e.g., phenylenediamine derivatives, aminophenol derivatives, etc.) in color development processing, can be used in addition to the couplers according to the present invention. Examples of conventional magenta couplers include 5-pyrazolone couplers, pyrazolobenzimidazole couplers, cyanoacetylcumarone couplers, open chain acylacetonitrile couplers, and the like. Examples of conventional yellow couplers include acylacetamide couplers (e.g., benzoyl acetanilides, pivaloyl acetanilides, etc.), and the like. Examples of conventional cyan couplers are naphthol couplers, phenol couplers, and the like. These couplers preferably contain hydrophobic groups called ballast groups in their molecule and are thereby rendered nondiffusible. Further, couplers in the form of a polymer are desirable. The couplers may be either 4-equivalent or 2-equivalent with respect to silver ions. Moreover, they may be colored couplers having a color correcting effect, or couplers capable of releasing development inhibitors with the progress of development (so-called DIR couplers). In addition to conventional DIR couplers, conventional colorless DIR coupling compounds which yield colorless products upon coupling and release development inhibitors may be used.

Hydrophilic colloidal layers of the photographic light-sensitive materials according to the present invention can contain ultraviolet absorbents. Usable ultraviolet absorbents include, for example, benzotriazole compounds substituted with aryl groups, such as those described in U.S. Pat. No. 3,533,794; 4-thiazolidone compounds, such as those described in U.S. Pat. Nos. 3,314,794 and 3,352,681; benzophenone compounds, such as those described in Japanese Patent Application (OPI) No. 2784/71; cinnamic ester compounds, such as those described in U.S. Pat. Nos. 3,705,805 and 3,707,375; butadiene compounds, such as those described in U.S. Pat. No. 4,045,229; and benzoxazole compounds, such as those described in U.S. Pat. No. 3,700,455. Compounds described in U.S. Pat. No. 3,499,762 and Japanese Patent Application (OPI) No. 48535/79 can also be used. In addition, ultraviolet absorbing couplers, such as α-naphthol type cyan forming couplers, and ultraviolet polymers may also be used. These ultraviolet absorbents may be fixed to specific layers using mordants.

Of the above recited ultraviolet absorbents, the particularly preferred are benzotriazoles substituted by aryl groups as represented by the formula (III):

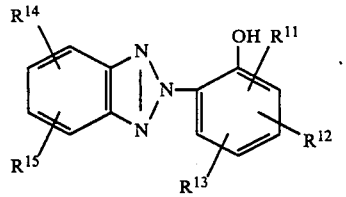

(III)

wherein $R^{11}$, $R^{12}$, $R^{13}$, $R^{14}$ and $R^{15}$, which may be the same or different, each represents a hydrogen atom, a halogen atom, a nitro group, a hydroxyl group, a substituted or unsubstituted alkyl group, a substituted or unsubstituted alkenyl group, a substituted or unsubstituted aryl group, a substituted or unsubstituted alkoxy group, a substituted or unsubstituted acyloxy group, a substituted or unsubstituted aryloxy group, a substituted or unsubstituted alkylthio group, a substituted or unsubstituted arylthio group, a substituted or unsubstituted mono- or dialkylamino group, a substituted or unsubstituted acylamino group or a substituted or unsubstituted 5- or 6-membered heterocyclic group containing at least one of oxygen and nitrogen atoms; and $R^{14}$ and $R^{15}$ may be taken together to form a 5- or 6-membered aromatic ring.

Specific examples of the ultraviolet absorbents represented by the formula (III) are shown below, but the present invention is not limited thereto.

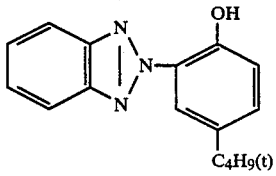

(UV-1)

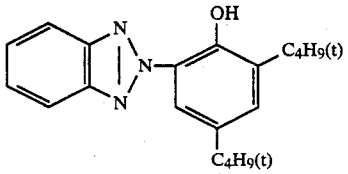

(UV-2)

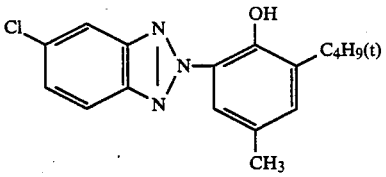

(UV-3)

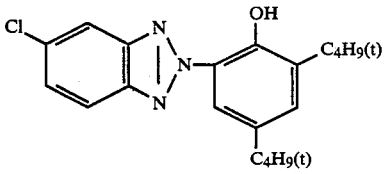

(UV-4)

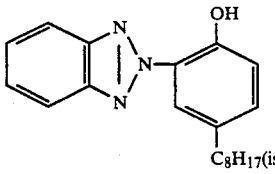

(UV-5)

-continued

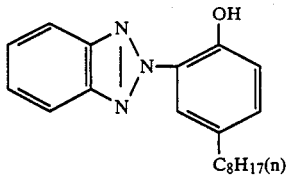

(UV-6)

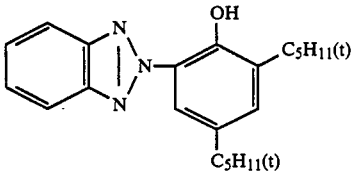

(UV-7)

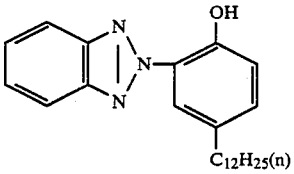

(UV-8)

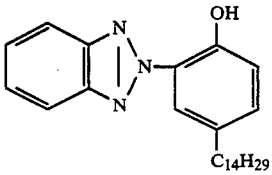

(UV-9)

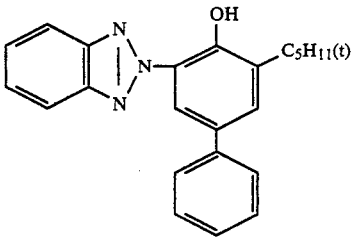

(UV-10)

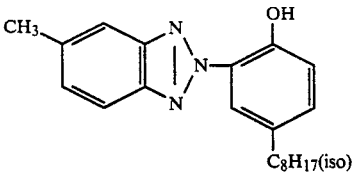

(UV-11)

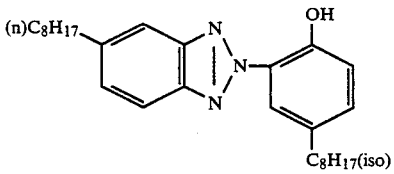

(UV-12)

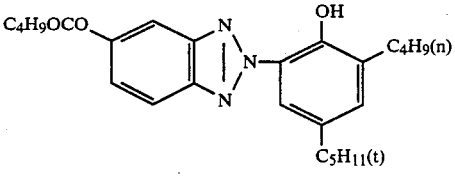

(UV-13)

-continued
(UV-14)
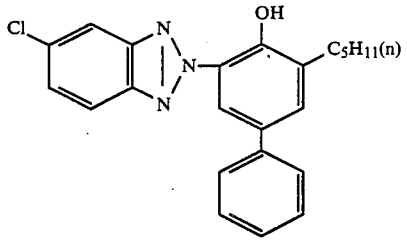
(UV-15)
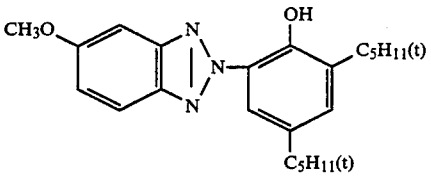
(UV-16)
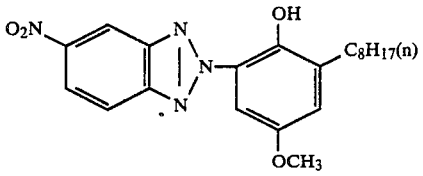
(UV-17)
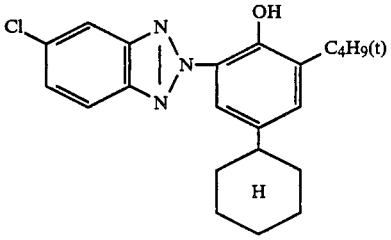
(UV-18)
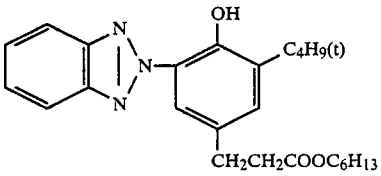
(UV-19)
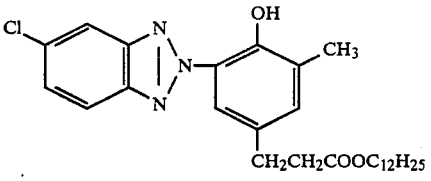
(UV-20)
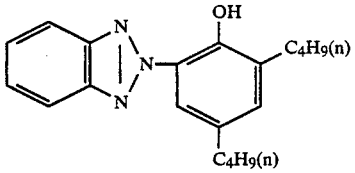
(UV-21)
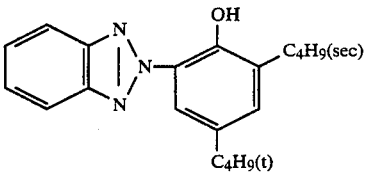
-continued
(UV-22)
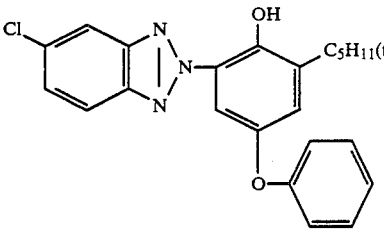
(UV-23)
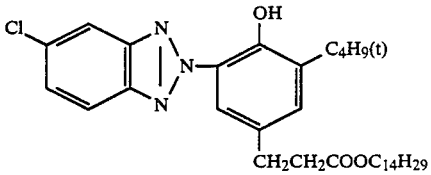
(UV-24)
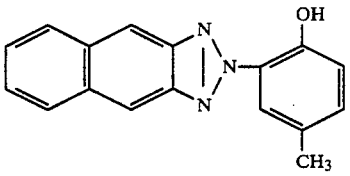
(UV-25)
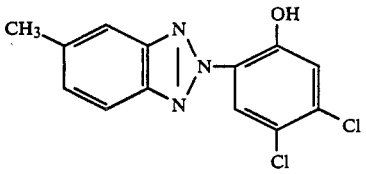
(UV-26)
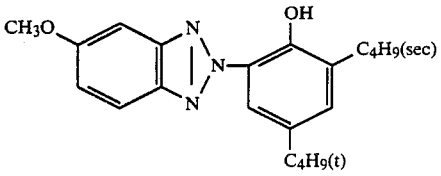
(UV-27)
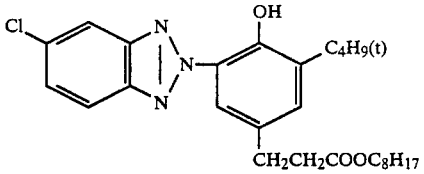
(UV-28)
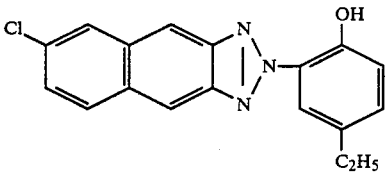
(UV-29)
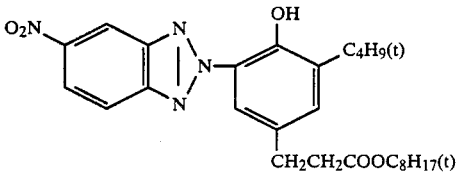

-continued

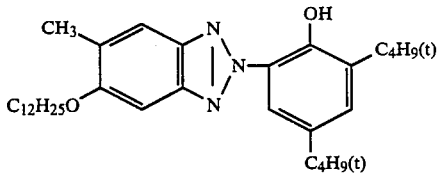

(UV-30)

These ultraviolet absorbents may be incorporated into any of the layers constituting the color light-sensitive materials of the present invention, but preferably are incorporated in a protective layer or an intermediate layer. When a protective layer is divided into two layers, the ultraviolet absorbent may be added to either layer. A suitable amount of the ultraviolet absorbent to be used ranges from $1\times10^{-4}$ to $2\times10^{-3}$ mol/m$^2$.

The color photographic light-sensitive material of the present invention can contain a color fog preventing agent, such as hydroquinone derivatives, aminophenol derivatives, gallic acid derivatives, ascorbic acid derivatives, and the like. Specific examples of these conventional color fog preventing agents are described, e.g., in U.S. Pat. Nos. 2,360,290, 2,336,327, 2,403,721, 2,418,613, 2,675,314, 2,701,197, 2,704,713, 2,728,659, 2,732,300 and 2,735,765, Japanese Patent Application (OPI) Nos. 92988/75, 92989/75, 93928/75, 110337/75 and 146235/77, Japanese Patent Publication No. 23813/75, etc.

Hydrophilic colloidal layers of the light-sensitive materials prepared in accordance with the present invention can contain water-soluble dyes as filter dyes or for other various purposes, including preventing of irradiation. Such water-soluble dyes include oxonol dyes, hemioxonol dyes, styryl dyes, merocyanine cyds, cyanine dyes and azo dyes, with oxonol dyes, hemioxonol dyes and merocyanine dyes being particularly useful. Specific examples of the usable dyes are described in British Patents Nos. 584,609 and 1,177,429, Japanese Patent Application (OPI) Nos. 85130/73, 99620/74, 114420/74 and 108115/77, U.S. Pat. Nos. 2,274,782, 2,533,472, 2,956,879, 3,148,187, 3,177,078, 3,247,127, 3,540,887, 3,575,704, 3,653,905, 3,718,472, 4,071,312 and 4,070,352, etc.

Silver halide emulsions which can be used in the present invention can generally be prepared by mixing a solution of a water-soluble silver salt (e.g., silver nitrate) and a solution of a water-soluble halogen salt (e.g., potassium bromide) in the presence of a solution of a water-soluble high polymer, e.g., gelatin. Silver halides that can be used include silver chloride, silver bromide and mixed silver halides, e.g., silver chlorobromide, silver iodobromide, silver chloriodobromide, etc. Silver halide grains preferably have a mean grain size (the grain size being defined as grain diameter if the grain has a spherical or a nearly spherical form and as a length of the edge if the grain has a cubic form, and being averaged based on projected areas of the grains) of not more than 2 μm, and more preferably not more than 0.4 μm. Grain size distribution may be either narrow or broad.

Silver halide grains may have a cubic form, an octahedral form or a composite form thereof, etc.

The silver halide grains may have a tabular form. In particular, emulsions containing 50% or more of tabular grains having a diameter/thickness ratio of 5 or more, and preferably 8 or more, based on the projected area of the total grains may be employed.

Two or more silver halide photographic emulsions separately prepared may be mixed. The silver halide grains may have a uniform crystal structure or a layered structure comprising an outer shell and a core. Silver halide grains of the so-called conversion type as described in British Patent No. 635,841 and U.S. Pat. No. 3,622,318 may be used. Moreover, the silver halide grains may be either a surface latent image type wherein a latent image is predominantly formed on the surface or an internal latent image type wherein a latent image is prediominantly formed in the interior thereof. These photographic emulsions are described in Mees, *The Theory of Photographic Process,* Macmillan; P. Grafkides, *Chimie Photographique,* Paul Montel (1957), etc., and are generally admitted in the art. These photographic emulsions can be prepared by the processes described, e.g., in P. Glafkides, *Chimie et Physique Photographique,* Paul Montel (1967); G. F. Duffin, *Photographic Emulsion Chemistry,* The Focal Press (1966); V. L. Zelikman et al., *Making and Coating Photographic Emulsion,* The Focal Press (1964), etc. More specifically, the emulsions can be produced by any of the acid process, the neutral process, the ammonia process, and the like. Reaction between a soluble silver salt and a soluble halogen salt can be effected by a single jet method, a double jet method or a combination thereof.

A method in which silver halide grains are produced in the presence of excess silver ions (the so-called reverse mixing method) can also be employed. In addition, the so-called controlled double jet method, in which the pAg of the liquid phase wherein silver halide grains are to be precipitated is maintained constant, may also be employed. According to this method, silver halide emulsions in which grains have a regular crystal form and almost uniform size distribution can be obtained.

In the process of producing silver halide grains or allowing the produced silver halide grains to physically ripen, cadmium salts, zinc salts, lead salts, thallium salts, iridium salts or complexes thereof, rhodium salts or complexes thereof, iron salts or complexes thereof and the like may be present.

Silver halide emulsions may be used as primitive emulsions without being subjected to chemical sensitization, but it is usual for the silver halide emulsions to be chemically sensitized. Chemical sensitization can be carried out in accordance with the processes described in the above literatures written by Glafkides or Zelikman et al. or H. Frieser (ed.), *Die Grundlagen der Photographischen Prozesse mit Silberhalogeniden,* Akademische Verlagsgesellschaft (1968).

The photographic emulsion which can be used in the present invention may be spectrally sensitized with methine dyes or others. Dyes used for spectral sensitization include cyanine dyes, merocyanine dyes, complex cyanine dyes, complex merocyanine dyes, holopolar cyanine dyes, hemicyanine dyes, styryl dyes and hemioxonol dyes, with cyanine dyes, merocyanine dyes and complex merocyanine dyes being particularly useful. Any of basic heterocyclic nuclei commonly employed for cyanine dyes can be applied to these dyes. Examples of such nuclei are a pyrroline nucleus, an oxazoline nucleus, a thiazoline nucleus, a pyrrole nucleus, an oxazole nucleus, a thiazole nucleus, a selenazole nucleus, an imidazole nucleus, a tetrazole nucleus, a pyridine nucleus, etc.; the above enumerated nuclei to which an alicyclic hydrocarbon ring is fused; and the above enumerated nuclei to which an aromatic hydrocarbon ring is fused, e.g., an indolenine nucleus, a benzindolenine nucleus, an indole nucleus, a benzoxazole nucleus, a naphthoxazole nucleus, a benzothiazole nucleus, a naphthothiazole nucleus, a benzoselenazole nucleus, a benzimidazole nucleus, a quinoline nucleus, etc. These nuclei may be substituted at their carbon atoms.

To merocyanine dyes or complex merocyanine dyes are applicable 5- or 6-membered heterocyclic nuclei having a ketomethylene structure, e.g., a pyrazolin-5-one nucleus, a thiohydantoin nucleus, a 2-thiooxazolidine-2,4-dione nucleus, a thiazolidine-2,4-dione nucleus, a rhodanine nucleus, a thiobarbituric acid nucleus, etc.

These sensitizing dyes may be used alone or in combinations thereof. In particular, combinations of sensitizing dyes are frequently adopted for the purpose of supersensitization.

The photographic emulsions may contain a dye which does not per se exhibit spectral sensitizing effect or a substance which does not substantially absorb visible light, both of which exhibit supersensitizing activity when employed in combination with a sensitizing dye. Such dye or substance includes, for example, aminostyryl compounds substituted with a nitrogen-containing heterocyclic group, e.g., those described in U.S. Pat. Nos. 2,933,390 and 3,635,721, condensation products between aromatic organic acids and formaldehyde, e.g., those described in U.S. Pat. No. 3,743,510, cadmium salts, azaindene compounds, and the like.

The color photographic emulsion layer in accordance with the presence invention is coated on a conventional flexible support, such as a plastic film, paper, cloth or the like. Examples of flexible supports which can be used to advantage include films made from semi-synthetic or synthetic high molecular weight polymers, such as cellulose acetate, cellulose acetate butyrate, polystyrene, polyethylene terephthalate, polycarbonate, etc.; and paper coated or laminated with a baryta layer or an α-olefin polymer (e.g., polyethylene, polypropylene). These supports may be colored with dyes or pigments. Further, they may be rendered black for the purpose of shielding light.

When these supports are used for reflective materials, it is preferable to add white pigments to the support or a laminate layer. White pigments that can be used include titanium dioxide, barium sulfate, zinc oxide, zinc sulfide, calcium carbonate, antimony trioxide, silica white, alumina white, titanium phosphate, and the like, with titanium dioxide, barium sulfate and zinc oxide being particularly useful.

The surfaces of these supports are, in general, subjected to a subbing treatment to increase adhesiveness to photographic emulsion layers or the like. Before or after receiving the subbing treatment, the surfaces of the support may be subjected to a corona discharge treatment, an ultraviolet irradiation treatment, a flame treatment or the like.

When these supports are used for reflective materials, a hydrophilic colloidal layer containing a white pigment at a high density can be provided between the support and the emulsion layers to ensure whiteness and sharpness of photographic images.

In reflective materials containing the magenta coupler according to the present invention, in which a paper support laminated with a polymer is often used, use of a synthetic resin film having blended therein a white pigment is particularly preferred because surface smoothness, gloss and sharpness can be improved and photographic image lines especially excellent in saturation and reproducibility of shadows can be obtained as well. In this case, materials that are particularly useful for the synthetic resin film are polyethylene terephthalate and cellulose acetate, and white pigments that are particularly useful are barium sulfate and titanium oxide.

The photographic material according to the present invention can have its surface side and reverse side laminated with a plastic film after development processing and drying. Useful plastic films for lamination include polyolefins, polyesters, polyacrylates, polyvinyl acetate, polystyrene, butadiene-styrene copolymers, polycarbonate, etc., with polyethylene terephthalate, vinyl alcohol/ethylene copolymers, polyethylene, etc., being particularly useful.

The silver halide color photographic light-sensitive material of the present invention can be applied to various uses, such as color negative films, color reversal films, color papers, and the like.

Conventional methods and processing solutions can be applied to photographic processing of the light-sensitive materials of the present invention. Processing temperatures are generally selected from the range of from 18° to 50° C., but temperatures out of the above range may also be employed. Any photographic processing, whether for the formation of silver images (monochromatic photographic processing) or for the formation of dye images (color photographic processing), can be applied depending on the end use of the light-sensitive material.

Color developing solutions generally comprise an alkaline aqueous solution containing a color developing agent. The color developing agents that can be used include known aromatic primary amine developers, such as phenylenediamines, e.g., 4-amino-N,N-diethylaniline, 3-methyl-4-amino-N,N-diethylaniline, 4-amino-N-ethyl-N-β-hydroxyethylaniline, 3-methyl-4-amino-N-ethyl-N-β-hydroxyethylaniline, 3-methyl-4-amino-N-ethyl-N-β-methanesulfonamidoethylaniline, 4-amino-3-methyl-N-ethyl-N-β-methoxyethylaniline, etc.

In addition to the above described color developing agents, those described in L. F. A. Mason, *Photographic Processing Chemistry*, 226–229, Focal Press (1966), U.S. Pat. Nos. 2,193,015 and 2,592,364 and Japanese Patent Application (OPI) No. 64933/73 may also be employed.

The color developing solution can additionally contain a pH buffer, such as a sulfite, carbonate, borate or phosphate of an alkali metal, etc.; a development restrainer, such as a bromide, an iodide and an organic antifoggant; or an antifoggant. It may further contain, if desired, a water softener; a preservative, such as hydroxylamine; an organic solvent, such as benzyl alcohol and diethylene glycol; a development accelerator, such as polyethylene glycol, a quaternary ammonium salt and an amine; a color forming coupler; a competing coupler; a fogging agent, such as sodium boron hydride; an assistant developer, such as 1-phenyl-3-pyrazolidone; a viscosity imparting agent, a polycarboxylic acid series chelating agent as described in U.S. Pat. No. 4,083,723; an antioxidant as described in West German Patent Application (OLS) No. 2,622,950; and the like.

After color development, the photographic emulsion layer is generally subjected to bleaching. Bleaching may be carried out simultaneously with fixing, or these two processes may be carried out separately. E. amples of bleaching agents which can be used include compounds of polyvalent metals, such as Fe (III), Co (III), Cr (VI), Cu (II), etc.; peracids, quinones, nitroso compounds, and the like. Specific examples of these bleaching agents are ferricyanides; bichromates; complex salts formed by Fe (III) or Co (III) and aminopolycarboxylic acids, such as ethylenediaminetetraacetic acid, nitrilotriacetic acid, 1,3-diamino-2-propanoltetraacetic acid, etc., or organic acids, such as citric acid, tartaric acid, malic acid, etc.; persulfates and permanganates; nitrosophenol; and the like. Among these agents, potassium ferricyanide, sodium (ethylenediaminetetraacetato)ferrate (III) and ammonium (ethylenediaminetetraacetato)ferrate (III) are particularly useful. The (ethylenediaminetetraacetato)iron (III) complexes are useful in both an independent bleaching solution and a combined bleach-fix bath.

The bleaching or the bleach-fix bath can contain a bleach accelerating agent as described in U.S. Pat. Nos. 3,042,520 and 3,241,966, Japanese Patent Publication Nos. 8506/70 and 8836/70, etc., a thiol compound as described in Japanese Patent Application (OPI) No. 65732/78, and other various kinds of additives.

The present invention will now be illustrated in greater detail with reference to the following examples, but it should be understood that these examples are not limiting the present invention.

EXAMPLE 1

In a mixture of 20 ml of tricresyl phosphate and 20 ml of ethyl acetate was dissolved 10 g of a magenta coupler, 1-(2,4,6-trichlorophenyl)-3-[(2-chloro-5-tetradecanamido)anilino]-2-pyrazolin-5-one. The solution was dispersed in 80 g of a gelatin solution containing 8 ml of a 1 wt% aqueous solution of sodium dodecylbenzenesulfonate.

The resulting emulsion was mixed with 145 g of a green-sensitive silver chlorobromide emulsion (bromine content: 50 mol%; Ag content: 7 g), and sodium dodecylbenzenesulfonate was added thereto as a coating aid. The resulting emulsion was coated on a paper support laminated on both sides thereof with polyethylene to a coupler coverage of 400 mg/m$^2$. Onto the emulsion layer was coated a gelatin protective layer to a gelatin coverage of 1 g/m$^2$. The resulting sample was designated as Sample A.

The same procedure as described above was repeated except that the coupler dispersion was prepared by using a combination of the coupler of the formula (I) according to the present invention and a dye image stabilizing agent of the formula (II) according to the present invention or a comparative dye image stabilizing agent as shown in Table 1. The compound of the formula (II) or the comparative compound was added in an amount of 50 mol% based on the coupler. The resulting samples were designated as Samples B to T.

Each of the samples was exposed to light of 1,000 lux for 1 second and subjected to the following processing.

| Processing | Temperature (°C.) | Time |
|---|---|---|
| Development | 33 | 3 min 30 sec |
| Bleach-Fix | 33 | 1 min 30 sec |
| Washing | 28–35 | 3 min |

Processing solutions used in each step had the following compositions:

| | |
|---|---|
| Developing Solution: | |
| Benzyl alcohol | 15 ml |
| Diethylenetriaminepentaacetic acid | 5 g |
| Potassium bromide | 0.4 g |
| $Na_2SO_3$ | 5 g |
| $Na_2CO_3$ | 30 g |
| Hydroxylamine sulfate | 2 g |
| 4-Amino-3-methyl-N—ethyl-N—β-(methanesulfonamido)ethylaniline.3/2$H_2SO_4$.$H_2O$ | 4.5 g |
| Water to make | 1 liter (pH = 10.1) |
| Bleach-Fix Bath: | |
| Ammonium thiosulfate (70 wt %) | 150 ml |
| $Na_2SO_3$ | 5 g |
| Na[Fe(EDTA)] | 40 g |
| EDTA | 4 g |
| Water to make | 1 liter (pH = 6.8) |

The sample having a dye image formed thereon was subjected to discoloration test for 6 days through an ultraviolet absorbing filter made by Fuji Photo Film Co., Ltd. which cut light of 400 nm or less using a xenon tester (illuminance: 200,000 lux). A change in density at the area having an initial density of 2.0 was determined using a Macbeth densitometer, RD-514 model (Status AA filter). The results obtained are shown in Table 1.

TABLE 1

| Sample No. | Magenta Coupler | Dye Image Stabilizing Agent | Magenta Density Change (initial density: 2.0) | Remark |
|---|---|---|---|---|
| A | Comparative Magenta Coupler (a) | — | −1.71 | Comparison |
| B | Comparative Magenta Coupler (a) | Comparative Compound (A) | −0.54 | Comparison |
| C | Comparative Magenta Coupler (a) | Comparative Compound (B) | −0.49 | Comparison |
| D | Comparative Magenta Coupler (a) | Comparative Compound (C) | −0.51 | Comparison |
| E | Comparative Magenta Coupler (a) | A-1 | −0.47 | Comparison |
| F | Comparative Magenta Coupler (a) | A-18 | −0.43 | Comparison |
| G | M-5 | — | −1.99 | Comparison |
| H | M-5 | Comparative Compound (A) | −0.71 | Comparison |
| I | M-5 | Comparative Compound (B) | −0.69 | Comparison |
| J | M-5 | Comparative Compound (C) | −0.69 | Comparison |
| K | M-5 | A-1 | −0.24 | Invention |
| L | M-5 | A-18 | −0.21 | Invention |
| M | M-6 | — | −1.72 | Comparison |
| N | M-6 | A-5 | −0.23 | Invention |
| O | M-6 | A-16 | −0.25 | Invention |
| P | M-6 | A-20 | −0.22 | Invention |
| Q | M-23 | — | −1.81 | Comparison |
| R | M-23 | A-11 | −0.27 | Invention |
| S | M-23 | A-16 | −0.24 | Invention |

TABLE 1-continued

| Sample No. | Magenta Coupler | Dye Image Stabilizing Agent | Magenta Density Change (initial density: 2.0) | Remark |
|---|---|---|---|---|
| T | M-23 | A-22 | −0.23 | Invention |

Note:
Comparative Magneta Coupler (a):
1-(2,4,6-Trichlorophenyl)-3-[(2-chloro-5-tetradecanamido)anilino]-2-pyrazolin-5-one
Comparative Compound (A):

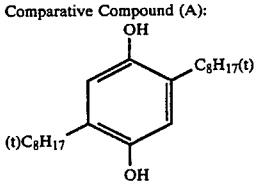

(disclosed in U.S. Pat. No. 3,935,016)
Comparative Compound (B):

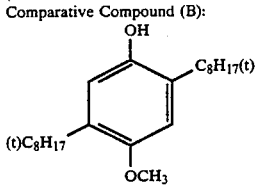

(disclosed in British Patent 2,066,975(B))
Comparative Compound (C):

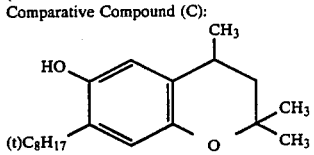

(disclosed in U.S. Pat. No. 3,432,300)

It can be seen from the results of Table 1 that the dye image stabilizing agents according to the present invention are superior to the known discoloration inhibitors in effect of improving light fastness and that the light fastness improving effect of these agents on the couplers according to the present invention is more conspicuous than on the conventional 5-pyrazolone magenta couplers.

EXAMPLE 2

A coating composition was prepared in the same manner as for Sample A in Example 1 except for using M-5 as a magenta coupler, and a multilayer sample having a layer structure as shown in Table 3 was produced using the resulting coating composition as a third layer. The resulting sample was designated as Sample a. Samples b, c and d were produced in the same manner as described above except that the coating composition for the third layer further contained a dye image stabilizing agent shown in Table 2. For comparison, Samples e and f were produced in the same manner as for Sample a except that the magenta coupler, M-5, was replaced by the Comparative Magenta Coupler (a) as used in Example 1, i.e., 1-(2,4,6-trichlorophenyl)-3-[(2-chloro-5-tetradecanamido)anilino]-2-pyrazolin-5-one, and the third layer in Sample f further contained a dye image stabilizing agent as shown in Table 2.

Each of the resulting samples was exposed and development processed in the same manner as in Example 1. The sample having formed thereon a dye image was subjected to a discoloration test using a fluorescent lamp fade tester (15,000 lux) for 4 weeks. The change in density at the area having an initial density of 1.0 was measured, and the results obtained are shown in Table 2.

It can be seen from these results that the dye image stabilizing agent according to the present invention produces a significant effect of light stabilization of a dye image formed by the magenta coupler of the formula (I) and that the effect becomes large with its amount. It was also noted that a combined use of the dye image stabilizing agent of the present invention with the conventional dye image stabilizing agent shows a synergistic effect.

Separately, each of these samples was subjected to exposure of blue-green-red three color separation and then to the same development processing as in Example 1. Comparison of the hue of the thus formed magenta color revealed that Samples b to d produce hues of excellent saturation equal to that produced by Sample a, indicating that addition of the compound according to the present invention gives no influence on the hue.

TABLE 2

| Sample No. | Dye Image Stabilizing Agent | Amount Added (mol %/coupler) | Magenta Density Change (initial density: 1.0) | Remark |
|---|---|---|---|---|
| a | — | — | −0.42 | Comparison |
| b | A-18 | 50 | −0.13 | Invention |
| c | A-18 | 100 | −0.07 | Invention |
| d | A-18 | 100 | −0.05 | Invention |
| | Comparative Compound (D) | 5 | | |
| e | — | — | −0.33 | Comparison |
| f | A-18 | 100 | −0.16 | Comparison |

Note:
Comparative Compound (D):

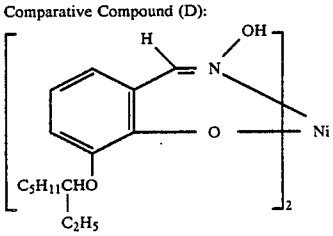

(disclosed in Japanese Patent Application (OPI) No. 83162/84)

TABLE 3

| Layer | Component | Coverage ($mg/m^2$) |
|---|---|---|
| 7th | Gelatin | 1,600 |
| 6th | Gelatin | 1,000 |
| | Ultraviolet absorbent(1) | 360 |
| | Solvent for ultraviolet absorbent(2) | 120 |
| 5th | Silver chlorobromide emulsion | 250 |
| | (Br: 50 mol %) | (as Ag) |
| | Cyan coupler(3) | 500 |
| | Solvent for coupler(2) | 250 |
| | Gelatin | 1,200 |
| 4th | Gelatin | 1,600 |
| | Ultraviolet absorbent(1) | 700 |
| | Color mixing preventing agent(4) | 200 |
| | Solvent(2) | 300 |
| 3rd | Silver chlorobromide emulsion | 180* |
| | (Br: 50 mol %) | (as Ag) |
| | Magenta coupler(5)(6) | 320** |
| | Solvent for coupler(7) | 320*** |
| 2nd | Gelatin | 1,100 |
| | Color mixing preventing agent(4) | 200 |
| | Solvent(2) | 100 |
| 1st | Silver chlorobromide emulsion | 350 |
| | (Br: 80 mol %) | (as Ag) |
| | Yellow coupler(8) | 500 |
| | Solvent for coupler(9) | 400 |
| | Gelatin | 1,500 |

TABLE 3-continued

| Layer | Component | Coverage (mg/m²) |
|---|---|---|
| Support | Paper support laminated with polyethylene on both sides thereof | |

Note:
(1)2-(2-Hydroxy-3-sec-butyl-5-t-butylphenyl)-benzotriazole (UV-21)
(2)Dibutyl phthalate
(3)2-[α-(2,4-Di-t-pentylphenoxy)butanamido]-4,6-dichloro-5-methylphenol
(4)2,5-Dioctylhydroquinone
(5)M-5
(6)Comparative Magenta Coupler (a)
(7)Tricresyl phosphate
(8)α-Pivaloyl-α-(2,4-dioxo-5,5'-dimethyl-oxazolidin-3-yl)-2-chloro-5-[α-(2,4-di-t-pentylphenoxy)butanamido]acetanilide
(9)Dioctylbutyl phosphate
*360 mg/m² for comparative samples
**280 mg/m² for the comparative magenta coupler
***280 mg/m² for comparative samples

EXAMPLE 3

A coating composition was prepared in the same manner as described for Sample b in Example 2, which contained M-5 as a magenta coupler and 50 mol%/coupler of A-18 as a dye image stabilizing agent. Multilayer Samples g, h and i were produced using the resulting coating composition as a third layer according to the same layer structure as shown in Table 3 except that the cyan coupler was replaced by 2-[α-(2,4-di-t-pentylphenoxy)butanamido]-4,6-dichloro-5-ethylphenol for Sample g; that the cyan coupler was replaced by an equimolar mixture of the same coupler as used in Sample g and 5-[2-(4-t-amyl-2-chlorophenoxy)octanamido]-4-chloro-2-(2-chlorobenzamido)phenol, and its coverage was increased 10% for Sample h; and that the coating composition for the first layer further contained bis-[2,2,6,6-tetramethyl-1-(1-oxo-2-propenyl)-4piperidinyl]-1,1-bis[(3,5-di-t-butyl-4-hydroxyphenyl)-methyl]propanediol in an amount of 20 mol% based on the cyan coupler for Sample i.

Each of Samples a, e and f as prepared in Example 2 and Samples g, h and i was exposed to light and development processed in the same manner as in Example 1 to obtain a dye image.

When the thus formed dye image was preserved at 100° C. for 7 days, the magenta density underwent substantially no change in each case. Further, when the dye image was preserved at 60° C. and 90% RH for 6 weeks, the magenta density did not substantially change in each case. It was also noted that the non-color-formed areas were free from stain. These results are shown in Table 4.

These results prove that the dye image stabilizing agent according to the present invention is effective to stabilize a dye image formed by the magenta coupler (I) according to the present invention against discoloration due to heat and humidity and is also effective to prevent formation of stains. It was also found that the effect of the dye image stabilizing agent according to the present invention is not influenced by a change of the composition of the adjacent layer.

TABLE 4

| Sample No. | Magenta Density Change (initial density: 1.0) 100° C., 7 Days | 60° C., 90% RH, 6 Weeks |
|---|---|---|
| a | 0.96 (0.16)* | 0.95 (0.18)* |
| e | 0.94 (0.38) | 0.93 (0.43) |
| f | 0.97 (0.37) | 0.95 (0.42) |
| g | 0.99 (0.14) | 0.98 (0.15) |
| h | 1.00 (0.14) | 0.98 (0.15) |
| i | 1.00 (0.13) | 0.98 (0.15) |

Note:
*Values in parentheses are densities (stain) of the non-color-formed area as measured using a blue filter.

EXAMPLE 4

Sample j was produced in the same manner as for Sample c in Example 2 except for using a white support which was prepared by coating a gelatin subbing layer onto a 150 μm thick polyethylene terephthalate film having incorporated therein barium sulfate as a white pigment.

When Sample j was exposed, development processed and subjected to a discoloration test in the same manner as in Example 2, the magenta dye image of this sample showed excellent light fastness similarly to Sample c of Example 2.

Further, a photographic image was printed on each of Sample j and Samples c and f as produced in Example 2 through a developed color negative using a printer. The sample was development processed in the same manner as in Example 1 to obtain a color print. The color print obtained from Sample j was found to have conspicuously improved saturation of a red series and a blue series over that obtained from Sample f. Further, the color print obtained from Sample j was superior to that obtained from Sample c in all respects, such as sharpness, hue and reproducibility of shadows, and presented a sharp image having remarkably improved saturation particularly in high density portions of a red series and a blue series. Furthermore, Sample j was found to be superior to Samples c and f in terms of surface smoothness and gloss.

EXAMPLE 5

Onto a triacetate film support were coated the following first to twelfth layers in the order listed below to prepare a color reversal photographic light-sensitive material.

First Layer: Antihalation Layer (gelatin layer containing black colloidal silver)

Second Layer: Intermediate Layer 2,5-Di-t-octylhyroquinone was dissolved in 100 ml of dibutyl phthalate and 100 ml of ethyl acetate, and the solution was stirred with 1 kg of a 10 wt% aqueous solution of gelatin at a high speed. 2 kg of the resulting emulsion was mixed with 1.5 kg of a 10% gelatin aqueous solution together with 1 kg of a fine grain emulsion (1 mol% silver iodobromide emulsion; grain size: 0.06 μm) which had not been chemically sensitized. The resulting emulsion was coated to a dry film thickness of 2 μm (silver coverage: 0.4 g/m²).

Third Layer: Low Sensitivity Red-Sensitive Emulsion Layer

In a mixture of 100 ml of tricresyl phosphate and 100 ml of ethyl acetate was dissolved 100 g of 2-(heptafluorobutyramido)-5-[2'(2",4"-di-t-amylphenoxy)-butyramido]phenol, i.e., a cyan coupler. The solution was stirred with 1 kg of a 10% gelatin aqueous solution at a high speed, and 500 g of the resulting emulsion was mixed with 1 kg of a red-sensitive silver iodobromide emulsion (silver content: 70 g; gelatin content: 60 g;

iodine content: 6 mol%). The resulting coating composition was coated to a dry film thickness of 1 μm (silver coverage: 0.5 g/m²).

Fourth Layer: High Sensitivity Red-Sensitive Emulsion Layer

In a mixture of 100 ml of tricresyl phosphate and 100 ml of ethyl acetate was dissolved 100 g of 2-(heptafluorobutyramido)-5-[2'-(2",4"-di-t-amylphenoxy)-butyramido]phenol, i.e., a cyan coupler. The solution was stirred with 1 kg of a 10 wt% gelatin aqueous solution at a high speed. 1 kg of the resulting emulsion was mixed with 1 kg of a red-sensitive silver iodobromide emulsion (silver content: 70 g; gelatin content: 60 g; iodine content: 6 mol%), and the resulting coating composition was coated to dry film thickness of 2.5 μm (silver coverage: 0.8 g/m²).

Fifth Layer: Intermediate Layer 2,5-Di-t-octylhydroquinone was dissolved in a mixture of 100 ml of dibutyl phthalate and 100 ml of ethyl acetate, and the solution was stirred with 1 kg of a 10 wt% gelatin aqueous solution at a high speed. 1 kg of the resulting emulsion was mixed with 1 kg of 10 wt% gelatin aqueous solution, and the resulting coating composition was coated to a dry film thickness of 1 μm.

Sixth Layer: Low Sensitivity Green-Sensitive Emulsion Layer

An emulsion was prepared in the same manner as for the emulsion of the third layer except for using 1-(2,4,6-trichlorophenyl)-3-[3-(2,4-di-t-amylphenoxyacetamido)benzamido]-5-pyrazolone, i.e., a magenta coupler, in place of the cyan coupler. 300 g of the resulting emulsion was mixed with 1 kg of a green-sensitive silver iodobromide emulsion (silver content: 70 g; gelatin content: 60 g; iodine content: 7 mol%), and the resulting coating composition was coated to a dry film thickness of 1.3 μm (silver coverage: 0.75 g/m²).

Seventh Layer: High Sensitivity Green-Sensitive Emulsion Layer

An emulsion was prepared in the same manner as for the emulsion of the third layer except for using 1-(2,4,6-trichlorophenyl)-3-[3-(2,4-di-t-amylphenoxyacetamido)benzamido]-5-pyrazolone, i.e., a magenta coupler, in place of the cyan coupler. 1 kg of the resulting emulsion was mixed with 1 kg of a green-sensitive silver iodobromide emulsion (silver content: 70 g; gelatin content: 60 g; iodine content: 6 mol%), and the resulting coating composition was coated to a dry film thickness of 3.5 μm (silver coverage: 1.1 g/m²).

Eighth Layer: Yellow Filter Layer

An emulsion containing yellow colloidal silver was coated to a dry film thickness of 1 μm.

Ninth Layer: Low Sensitivity Blue-Sensitive Emulsion Layer

An emulsion was prepared in the same manner as for the emulsion used in the third layer except for using α-(pivaloyl)-α-(1-benzyl-5-ethoxy-3-hydantoinyl)-2-chloro-5-dodecyloxycarbonylacetanilide, i.e., a yellow coupler, in place of the cyan coupler. 1 kg of the resulting emulsion was mixed with 1 kg of a blue-sensitive silver iodobromide emulsion (silver content: 70 g; gelatin content: 60 g; iodine content: 7 mol%), and the resulting coating composition was coated to a dry film thickness of 1.5 μm (silver coverage: 0.4 g/m²).

Tenth Layer: High Sensitivity Blue-Sensitive Emulsion Layer

An emulsion was prepared in the same manner as for the emulsion used in the third layer except for using α-(pivaloyl)-α-(1-benzyl-5-ethoxy-3-hydantoinyl)-2-chloro-5-dodecyloxycarbonylacetanilide, i.e., a yellow coupler, in place of the cyan coupler. 1 kg of the resulting emulsion was mixed with 1 kg of a blue-sensitive silver iodobromide emulsion (silver content: 70 g; gelatin content: 60 g; iodine content: 6 mol%), and the resulting coating composition was coated to a dry film thickness of 3 μm (silver coverage: 0.8 g/m²).

Eleventh Layer: Second Protective Layer

A mixture of 15 g of 5-chloro-2-(2-hydroxy-3,5-di-t-butylphenyl)-2H-benzotriazole (i.e., ultraviolet absorbent), 30 g of 2-(2-hydroxy-5-t-butylphenyl)-2H-benzotriazole, 35 g of 2-(2-hydroxy-3-sec-butyl-5-t-butylphenyl)-2H-benzotriazole and 100 g of dodecyl 5-(N,N-diethylamino)-2-benzenesulfonyl-2,4-pentadienoate was mixed with 200 ml of tricresyl phosphate, 200 ml of ethyl acetate, 20 g of sodium dodecylbenzenesulfonate and a 10 wt% of gelatin aqueous solution and the mixture was stirred at a high speed to obtain an emulsion. The resulting emulsion was mixed with a 10% gelatin aqueous solution, water and a coating aid and, then, the resulting coating composition was coated to a dry film thickness of 2 μm.

Twelfth Layer: First Protective Layer

A 10 wt% gelatin aqueous solution containing an emulsion of fine grains having the surfaces thereof fogged (a 1 mol% silver iodobromide emulsion; grain size: 0.06 μm) was coated to a dry film thickness of 0.8 μm (silver coverage: 0.1 g/m²).

The thus prepared sample was designated as Sample A.

Samples B to G were produced in the same manner as for Sample A except that the magenta coupler used in the sixth and seventh layers and the cyan coupler used in the third and fourth layers were replaced by the couplers shown in Table 5 and that Compound A-18 of the formula (II) was added to the sixth and seventh layers of Samples E to G as shown in Table 5.

TABLE 5

| Sample No. | Magenta Coupler | Cyan Coupler | Dye Image Stabilizing Agent* |
|---|---|---|---|
| A (Comparison) | See above | See above | None |
| B (Comparison) | M-2 | Compound 1** | " |
| C (Comparison) | " | Compound 2** | " |
| D (Comparison) | " | Compound 3** | " |
| E (Invention) | " | Compound 1** | A-18 |
| F (Invention) | " | Compound 2** | " |
| G | " | Compound 3** | " |

TABLE 5-continued

| Sample No. | Magenta Coupler | Cyan Coupler | Dye Image Stabilizing Agent* |
|---|---|---|---|
| (Invention) | | | |

Note:
*A-18 was added in an amount of 50 mol % based on the coupler in the respective layer.
**Compound 1:

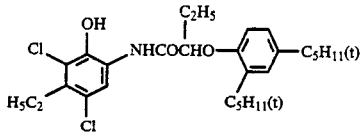

Compound 2:

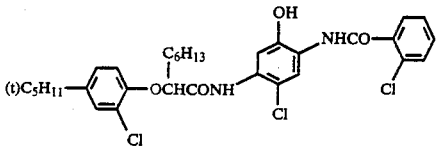

Compound 3:

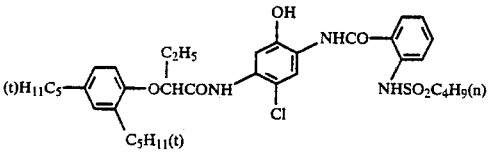

Each of the samples was exposed to white light emitted from a light source of 4,800° K. with an illuminance of 1,000 lux through a continuous gray wedge and then subjected to the following development processing to obtain a dye image.

Development Processing:

| Step | Time | Temperature |
|---|---|---|
| First Development | 6 minutes | 38° C. |
| Washing | 2 minutes | " |
| Reversal | 2 minutes | " |
| Color Development | 6 minutes | " |
| Compensation | 2 minutes | " |
| Bleaching | 6 minutes | " |
| Fixing | 4 minutes | " |
| Washing | 4 minutes | " |
| Stabilization | 1 minute | Room Temperature |
| Drying | | |

Processing solutions used had the following compositions.

| | |
|---|---|
| First Developing Solution: | |
| Water | 700 ml |
| Sodium tetrapolyphosphate | 2 g |
| Sodium sulfite | 20 g |
| Hydroquinone monosulfonate | 30 g |
| Sodium carbonate monohydrate | 30 g |
| 1-Phenyl-4-methyl-4-hydroxymethyl-3-pyrazolidone | 2 g |
| Potassium bromide | 2.5 g |
| Potassium thiocyanate | 1.2 g |
| Potassium iodide (0.1 wt % aq. soln.) | 2 ml |
| Water to make | 1 liter (ph = 10.1) |
| Reversal Solution: | |
| Water | 700 ml |
| Nitro-N,N,N—trimethyleneosmic acid.6Na salt | 3 g |
| Stannous chloride dihydrate | 1 g |
| p-Aminophenol | 0.1 g |
| Sodium hydroxide | 8 g |
| Glacial acetic acid | 15 ml |
| Water to make | 1 liter |

-continued

| | |
|---|---|
| Color Developing Solution: | |
| Water | 700 ml |
| Sodium tetrapolyphosphate | 2 g |
| Sodium sulfite | 7 g |
| Sodium tertiary phosphate dodecahydrate | 36 g |
| Potassium bromide | 1 g |
| Potassium iodide (0.1 wt % soln.) | 90 ml |
| Sodium hydroxide | 3 g |
| Citrazinic acid | 1.5 g |
| N—Ethyl-N—(β-methanesulfonamidoethyl)-3-methyl-4-aminoaniline sulfate | 11 g |
| Ethylenediamine | 3 g |
| Water to make | 1 liter |
| Compensating Solution: | |
| Water | 700 ml |
| Sodium sulfite | 12 g |
| Sodium ethylenediaminetetraacetate dihydrate | 8 g |
| Thioglycerin | 0.4 ml |
| Glacial acetic acid | 3 ml |
| Water to make | 1 liter |
| Bleaching Solution: | |
| Water | 800 g |
| Sodium ethylenediaminetetraacetate dihydrate | 2.0 g |
| Ammonium (ethylenediaminetetraacetato)-ferrate (III) dihydrate | 120.0 g |
| Potassium bromide | 100.0 g |
| Water to make | 1 liter |
| Fixing Solution: | |
| Water | 800 ml |
| Ammonium thiosulfate | 80.0 g |
| Sodium sulfite | 5.0 g |
| Sodium bisulfite | 5.0 g |
| Water to make | 1 liter |
| Stabilizer: | |
| Water | 800 ml |
| Formalin (37 wt %) | 5.0 ml |
| Fuji Driwel | 5.0 ml |
| Water to make | 1 liter |

Each of the samples having formed thereon a dye image was subjected to discoloration test using a fluorescent lamp fade tester (illuminance: 15,000 lux) for 4 weeks through an ultraviolet absorbing filter which cut light of 400 nm or less (made by Fuji Photo Film Co., Ltd). Before and after the discoloration test, maxima of the cyan density (Dc), magenta density (Dm) and yellow density (Dy) were measured, and the results obtained are shown in Table 6.

TABLE 6

| Before Discoloration | | | After Discoloration | | |
|---|---|---|---|---|---|
| Dc | Dm | Dy | Dc | Dm | Dy |
| 2.85 | 2.95 | 3.02 | 2.32 | 2.20 | 2.60 |
| 2.98 | 3.02 | 3.00 | 2.76 | 2.70 | 2.59 |
| 3.03 | 3.04 | 3.01 | 2.81 | 2.73 | 2.63 |
| 3.10 | 3.02 | 3.00 | 2.92 | 2.72 | 2.62 |
| 2.98 | 3.03 | 3.00 | 2.76 | 2.90 | 2.65 |
| 3.02 | 3.04 | 3.01 | 2.83 | 2.92 | 2.64 |
| 3.09 | 3.03 | 3.02 | 2.90 | 2.92 | 2.65 |

As is apparent from Table 6, Samples E to G according to the present invention show high maximum image densities before discoloration compared with Comparative Sample A and suffer from less reduction in magenta density due to discoloration, as compared with Comparative Samples B to D, exhibiting the superior light fastness of Samples E to G of the present invention.

While the invention has been described in detail and with reference to specific embodiments thereof, it will be apparent to one skilled in the art that various changes and modifications can be made therein without departing from the spirit and scope thereof.

What is claimed is:

1. A silver halide color photographic light-sensitive material comprising a support having provided thereon at least one layer containing at least one pyrazolo-azole coupler represented by the formula (I):

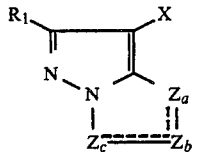

(I)

wherein $R_1$ represents a hydrogen atom or an organic substituent; X represents a hydrogen atom or a group releasable upon a coupling reaction with an oxidation product of an aromatic primary amine developing agent; $Z_a$, $Z_b$ and $Z_c$ each represents a methine group, a substituted methine group, =N— or —NH—, with the proviso that the case wherein $Z_a$ and $Z_b$ are nitrogen atoms and $Z_c$ is a methine group or a substituted methine group is excluded; the dotted line represents a single bond or a double bond and one of $Z_a$-$Z_b$ bond and $Z_b$-$Z_c$ bond is a double bond and the other is a single bond; when $Z_b$-$Z_c$ is a carbon-carbon double bond, $Z_b$-$Z_c$ may be a part of a condensed aromatic ring; when $R_1$ or X is a divalent group, the compound of the general formula (I) may form a di- or polymer; and when $Z_a$, $Z_b$ or $Z_c$ is a substituted methine group, the compound of the general formula (I) may form a di- or polymer; and at least one compound represented by the formula (II):

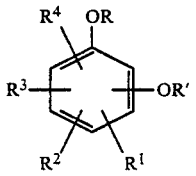

(II)

wherein R and R', which may be the same or different, each represents an alkyl group; $R^1$, $R^2$, $R^3$ and $R^4$, which may be the same or different, each represents a hydrogen atom, an alkyl group, an aryl group, an alkoxy group, an alkylthio group, an acylamino group, a hydroxyl group or a halogen atom; at least one of OR and OR' may be taken together with any of $R^1$, $R^2$, $R^3$ and $R^4$ that is in an ortho-position to OR or OR' to form a 5- or 6-membered ring; and at least one of pairs of $R^1$, $R^2$, $R^3$ and $R^4$, two groups constituting each pair being in an ortho-position to each other, may be taken together to form a 5- or 6-membered ring, with the proviso that OR' is in a position ortho or para to OR.

2. A silver halide color photographic light-sensitive material as claimed in claim 1, wherein said coupler is a 1H-imidazo[1,2-b]pyrazole represented by the formula (I-1), a 1H-pyrazolo[1,5-b]pyrazole represented by the formula (I-2), a 1H-pyrazolo[1,5-b][1,2,4]triazole represented by the formula (I-3), a 1H-pyrazolo[1,5-d]tetrazole represented by the formula (I-4) or a 1H-pyrazolo[1,5-a]benzimidazole represented by the formula (I-5):

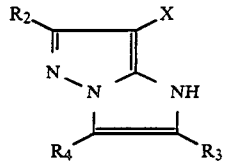

(I-1)

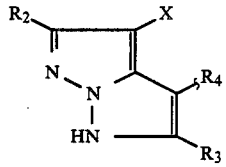

(I-2)

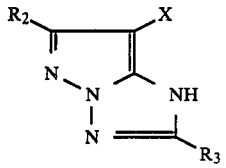

(I-3)

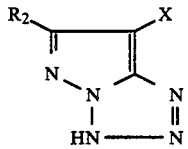

(I-4)

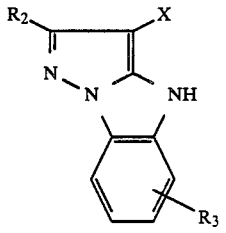

(I-5)

wherein $R_2$, $R_3$ and $R_4$ each represents a hydrogen atom, a halogen atom, an alkyl group, an aryl group, a heterocyclic group, a cyano group, an alkoxy group, an aryloxy group, a heterocyclic oxy group, an acyloxy group, a carbamoyloxy group, a silyloxy group, a sulfonyloxy group, an acylamino group, an anilino group, a ureido group, an imido group, a sulfamoylamino group, a carbamoylamino group, an alkylthio group, an arylthio group, a heterocyclic thio group, an alkoxycarbonylamino group, an aryloxycarbonylamino group, a sulfonamido group, a carbamoyl group, an acyl group, a sulfamoyl group, a sulfonyl group, a sulfinyl group, an alkoxycarbonyl group or an aryloxycarbonyl group; X represents a hydrogen atom, a halogen atom, a carboxyl group or a group which is bonded to the coupling carbon atom via an oxygen, nitrogen or sulfur atom and capable of releasing upon coupling; when $R_2$, $R_3$, $R_4$ or X is a divalent group, the compound represented by the formula (I-1), (I-2), (I-3), (I-4) or (I-5) forms a di- or polymer; and when the formula (I-1), (I-2), (I-3), (I-4) or (I-5) constitutes a partial structure of a vinyl monomer, $R_2$, $R_3$ or $R_4$ represents a mere bond or a linking group, via which said partial structure and the vinyl group are bonded together.

3. A silver halide color photographic light-sensitive material as claimed in claim 2, wherein said coupler is present in an amount of from $2\times10^{-3}$ to $5\times10^{-1}$ mol per mol of silver.

4. A silver halide color photographic light-sensitive material as claimed in claim 2, wherein said coupler is present in an amount of from $1\times10^{-2}$ to $5\times10^{-1}$ mol per mol of silver.

5. A silver halide color photographic light-sensitive material as claimed in claim 2, wherein said compound of the formula (II) is represented by the formula (II-1), (II-2), (II-3), (II-4) or (II-5):

(II-1)

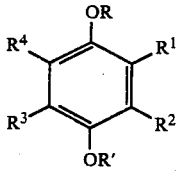

(II-2)

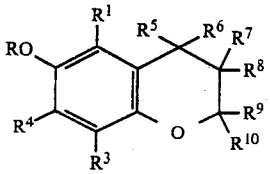

(II-3)

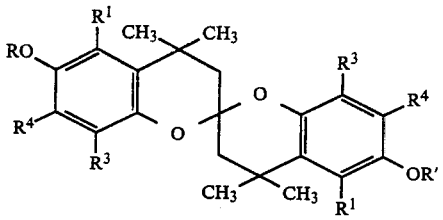

(II-4)

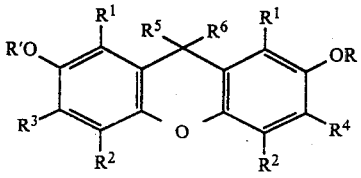

(II-5)

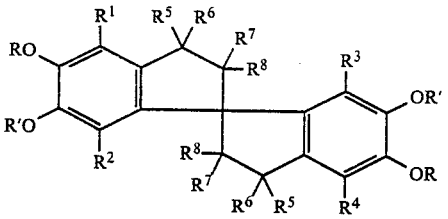

wherein R and R′, which may be the same or different, each represents an alkyl group; $R^1$, $R^2$, $R^3$ and $R^4$, which may be the same or different, each represents a hydrogen atom, an alkyl group, an aryl group, an alkoxy group, an alkylthio group, an acylamino group, a hydroxyl group or a halogen atom; at least one of OR or OR′ may be taken together with any of $R^1$, $R^2$, $R^3$ and $R^4$ that is in an ortho-position to OR or OR′ to form a 5- or 6-membered ring; and at least one of pairs of $R^1$, $R^2$, $R^3$ and $R^4$, two groups constituting each pair being in an ortho-position to each other, may be taken together to form a 5- or 6-membered ring; and $R^5$, $R^6$, $R^7$, $R^8$, $R^9$ and $R^{10}$, which may be the same or different, each represents a hydrogen atom, an alkyl group, an aryl group, an alkoxy group, a heterocyclic group, an alkylamino group or an alkoxycarbonyl group.

6. A silver halide color photographic light-sensitive material as claimed in claim 2, wherein said compound of the formula (II) is present in an amount of from 2 to 300 mol% based on the coupler.

7. A silver halide color photographic light-sensitive material as claimed in claim 2, wherein said compound of the formula (II) is present in an amount of from 10 to 150 mol% based on the coupler.

8. A silver halide color photographic light-sensitive material as claimed in claim 2, wherein said compound of the formula (II) is represented by the formula (II-5):

(II-5)

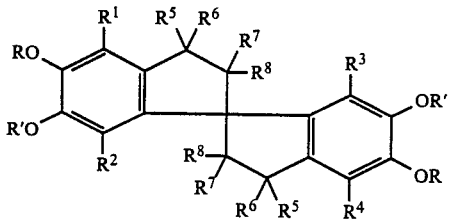

wherein R and R′, which may be the same or different, each represents an alkyl group; $R^1$, $R^2$, $R^3$ and $R^4$, which may be the same or different, each represents a hydrogen atom, an alkyl group, an aryl group, an alkoxy group, an alkylthio group, an acylamino group, a hydroxyl group or a halogen atom; at least one of OR and OR′ may be taken together with any of $R^1$, $R^2$, $R^3$ and $R^4$ that is in an ortho-position to OR or OR′ to form a 5- or 6-membered ring; and at least one of pairs of $R^1$, $R^2$, $R^3$ and $R^4$, two groups constituting each pair being in an ortho-position to each other, may be taken together to form a 5- or 6-membered ring; and $R^5$, $R^6$, $R^7$ and $R^8$, which may be the same or different, each represents a hydrogen atom, an alkyl group, an aryl group, an alkoxy group, a heterocyclic group, an alkylamino group or an alkoxycarbonyl group.

9. A silver halide color photographic light-sensitive material as claimed in claim 1, wherein said coupler is a 1H-imidazo[1,2-b]pyrazole represented by the formula (I-1) or a 1H-pyrazolo[1,5-b][1,2,4]triazole represented by the formula (I-3):

(I-1)

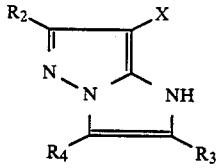

(I-3)

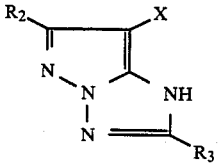

wherein $R_2$, $R_3$ and $R_4$ each represents a hydrogen atom, a halogen atom, an alkyl group, an aryl group, a heterocyclic group, a cyano group, an alkoxy group, an aryloxy group, a heterocyclic oxy group, an acyloxy group, a carbamoyloxy group, a silyloxy group, a sulfonyloxy group, an acylamino group, an anilino group, a ureido group, an imido group, a sulfamoylamino group, a carbamoylamino group, an alkylthio group, an arylthio group, a heterocyclic thio group, an alkoxycarbonylamino group, an aryloxycarbonylamino group, a sulfonamido group, a carbamoyl group, an acyl group, a sulfamoyl group, a sulfonyl group, a sulfinyl group, an alkoxycarbonyl group or an aryloxycarbonyl group; X represents a hydrogen atom, a halogen atom, a carboxyl group or a group which is bonded to the coupling carbon atom via an oxygen, nitrogen or sulfur atom and capable of releasing upon coupling; when $R_2$, $R_3$, $R_4$ or X is a divalent group, the compound represented by the formula (I-1) or (I-3) form a di- or polymer; and when the formula (I-1) or (I-3) constitutes a partial structure of a vinyl monomer, $R_2$, $R_3$ or $R_4$ represents a mere bond or a linking group, via which said partial structure and the vinyl group are bonded together; and said compound is the compound represented by the formula (II):

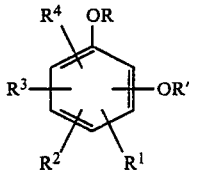

(II)

wherein R and R', which may be the same or different, each represents an alkyl group; $R^1$, $R^2$, $R^3$ and $R^4$, which may be the same or different, each represents a hydrogen atom, an alkyl group, an aryl group, an alkoxy group, an alkylthio group, an acylamino group, a hydroxyl group or a halogen atom; at least one of OR and OR' may be taken together with any of $R^1$, $R^2$, $R^3$ and $R^4$ that is in an ortho-position to OR or OR' to form a 5-or 6-membered ring; and at least one of pairs of $R^1$, $R^2$, $R^3$ and $R^4$, two groups constituting each pair being in an ortho-position to each other, may be taken together to form a 5- or 6-membered ring.

10. A silver halide color photographic light-sensitive material as claimed in claim 9, wherein said coupler is present in an amount of from $2\times10^{-3}$ to $5\times10^{-1}$ mol per mol of silver.

11. A silver halide color photographic light-sensitive material as claimed in claim 9, wherein said coupler is present in an amount of from $1\times10^{-2}$ to $5\times10^{-1}$ mol per mol of silver.

12. A silver halide color photographic light-sensitive material as claimed in claim 9, wherein said compound of the formula (II) is represented by the formula (II-1), (II-2), (II-3), (II-4) or (II-5):

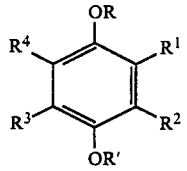

(II-1)

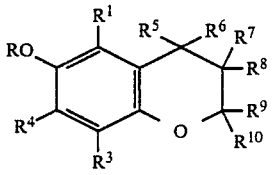

(II-2)

-continued

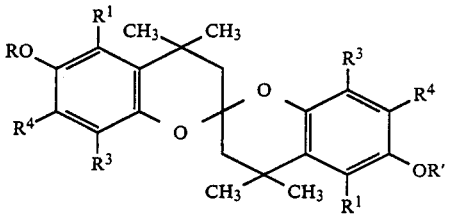

(II-3)

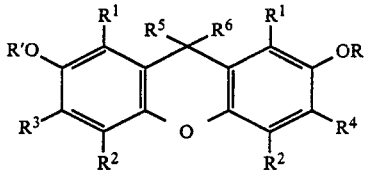

(II-4)

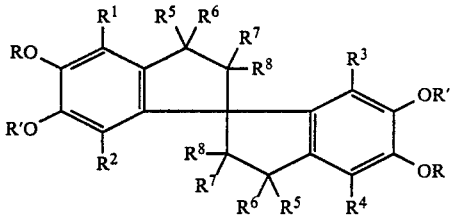

(II-5)

wherein R, R', $R^1$, $R^2$, $R^3$ and $R^4$ are as defined in claim 9; and $R^5$, $R^6$, $R^7$, $R^8$, $R^9$ and $R^{10}$, which may be the same or different, each represents a hydrogen atom, an alkyl group, an aryl group, an alkoxy group, a heterocyclic group, an alkylamino group or an alkoxycarbonyl group.

13. A silver halide color photographic light-sensitive material as claimed in claim 9, wherein said compound of the formula (II) is present in an amount of from 2 to 300 mol% based on the coupler.

14. A silver halide color photographic light-sensitive material as claimed in claim 9, wherein said compound of the formula (II) is present in an amount of from 10 to 150 mol% based on the coupler.

15. A silver halide color photographic light-sensitive material as claimed in claim 9, wherein said compound of the formula (II) is represented by the formula (II-5):

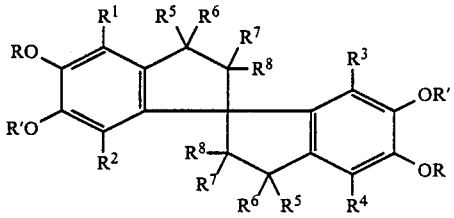

(II-5)

wherein R, R', $R^1$, $R^2$, $R^3$ and $R^4$ are as defined in claim 9; and $R^5$, $R^6$, $R^7$ and $R^8$, which may be the same or different, each represents a hydrogen atom, an alkyl group, an aryl group, an alkoxy group, a heterocyclic group, an alkylamino group or an alkoxycarbonyl group.

16. A silver halide color photographic light-sensitive material as claimed in claim 1, wherein said compound is A-18 or A-19 having the following formulae:

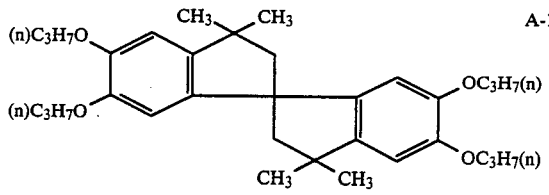

A-18

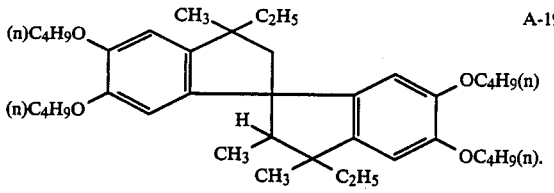

A-19

17. A silver halide color photographic light-sensitive material as claimed in claim 2, wherein said compound is A-18 or A-19 having the following formulae:

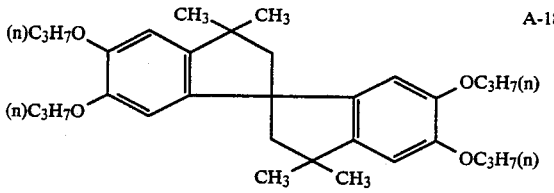

A-18

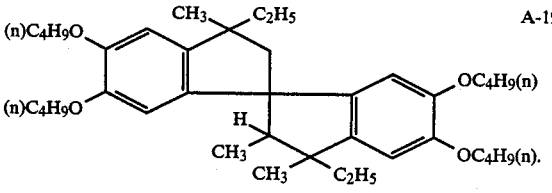

A-19

18. A silver halide color photographic light-sensitive material as claimed in claim 2, wherein said coupler is a 1H-pyrazolo 1,5-b 1,2,4 triazole represented by the formula (I-3):

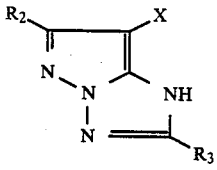

(I-3)

wherein $R_2$, $R_3$ and $R_4$ are as defined in claim 2; and said compound is A-18 or A-19 having the following formulae:

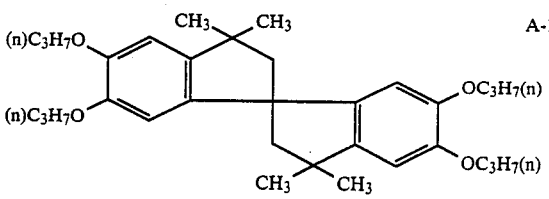

A-18

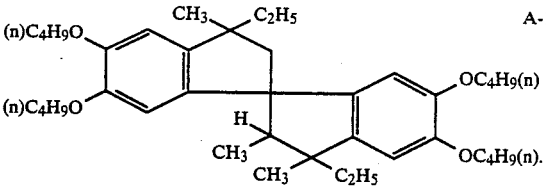

A-19

19. A silver halide color photographic light-sensitive material as claimed in claim 9, wherein said coupler is a 1H-pyrazolo[1,5-b][1,2,4]triazole represented by the formula (I-3):

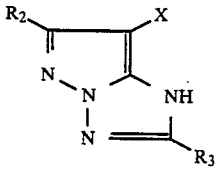

(I-3)

wherein $R_2$, $R_3$ and $R_4$ are as defined in claim 9; and said compound is represented by the formula (II-5):

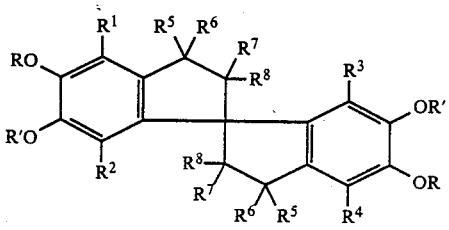

(II-5)

wherein R, R', $R^1$, $R^2$, $R^3$ and $R^4$ are as defined in claim 9; and $R^5$, $R^6$, $R^7$ and $R^8$, which may be the same or different, each represents a hydrogen atom, an alkyl group, an aryl group, an alkoxy group, a heterocyclic group, an alkylamino group or an alkoxycarbonyl group.

20. A silver halide color photographic light-sensitive material as claimed in claim 1, wherein OR and OR' are para.

21. A silver halide color photographic light-sensitive material as claimed in claim 1, wherein OR and OR' are ortho.

* * * * *